US010205282B2

(12) United States Patent
Wu et al.

(10) Patent No.: US 10,205,282 B2
(45) Date of Patent: Feb. 12, 2019

(54) COAXIAL CONNECTOR WITH QUICK LOCKING AND SEPARATING MECHANISM

(71) Applicant: CommScope Technologies LLC, Hickory, NC (US)

(72) Inventors: Jianping Wu, Suzhou (CN); Yujun Zhang, Suzhou (CN); Yujun Dai, Suzhou (CN); Mulan Huang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/895,611

(22) Filed: Feb. 13, 2018

(65) Prior Publication Data

US 2018/0248314 A1 Aug. 30, 2018

Related U.S. Application Data

(63) Continuation of application No. 15/098,987, filed on Apr. 14, 2016, now Pat. No. 9,893,466.

(30) Foreign Application Priority Data

Apr. 14, 2015 (CN) ..... 2015 1 0175690

(51) Int. Cl.
*H01R 13/639* (2006.01)
*H01R 24/38* (2011.01)
(Continued)

(52) U.S. Cl.
CPC ..... *H01R 13/639* (2013.01); *H01R 13/6275* (2013.01); *H01R 13/6277* (2013.01);
(Continued)

(58) Field of Classification Search
CPC ..... H01R 13/6277; H01R 13/6275; H01R 13/639; H01R 24/38
See application file for complete search history.

(56) References Cited

U.S. PATENT DOCUMENTS 3,622,939 A * 11/1971 Forney, Jr. ..... H01R 9/0521 439/322
4,377,320 A * 3/1983 Lathrop ..... H01R 24/40 439/585

(Continued)

FOREIGN PATENT DOCUMENTS

| | | |
|---|---|---|
| CN | 202940383 U | 5/2013 |
| EP | 0050575 A1 | 4/1982 |
| JP | 2007-179924 | 7/2007 |

OTHER PUBLICATIONS

Extended European Search Report corresponding to European Application No. 16780728.8 dated Nov. 2, 2018.

*Primary Examiner* — Briggitte R Hammond
(74) *Attorney, Agent, or Firm* — Myers Bigel, P.A.

(57) ABSTRACT

A coaxial connector includes: a first joint and a second joint, a locking flange arranged at one end portion of the second joint; and a quick locking and separating mechanism that includes: a locking member fixedly arranged on a first end portion of the first joint and provided with a depression for accommodating the locking flange of the second joint; and a sliding sleeve arranged around the first joint and being slidable between a locking position in which the sliding sleeve locks the locking flange of the second joint in the depression of the locking member so as to connect the first joint and the second joint and an unlocking position in which the sliding sleeve allows the locking flange of the second joint to disengage from the depression of the locking member so as to allow the first joint to be separated from the second joint.

21 Claims, 18 Drawing Sheets

(51) Int. Cl.
*H01R 24/40* (2011.01)
*H01R 13/627* (2006.01)
*H01R 103/00* (2006.01)

(52) U.S. Cl.
CPC ..... *H01R 24/38* (2013.01); *H01R 24/40* (2013.01); *H01R 2103/00* (2013.01)

(56) References Cited

U.S. PATENT DOCUMENTS 5,176,533 A * 1/1993 Sakurai ..... H01R 13/6277 439/350
5,454,735 A * 10/1995 Nelson ..... H01R 13/6277 439/578
5,595,499 A * 1/1997 Zander ..... H01R 13/6277 439/352
6,267,612 B1 * 7/2001 Arcykiewicz ..... H01R 13/6275 439/253
6,607,403 B2 * 8/2003 Tschope ..... H01R 13/5202 439/607.42
6,645,011 B2 * 11/2003 Schneider ..... H01R 13/6277 439/578
6,692,286 B1 2/2004 De Cet
6,884,105 B2 * 4/2005 Turck ..... H01R 13/6273 439/352
7,207,820 B1 * 4/2007 Montena ..... H01R 13/5219 439/275
7,238,047 B2 * 7/2007 Saettele ..... H01R 13/627 439/253
7,351,101 B1 * 4/2008 Montena ..... H01R 9/0521 439/584
7,722,379 B2 * 5/2010 Yang ..... H01R 13/6277 439/352
7,972,158 B2 * 7/2011 Wild ..... H01R 13/6277 439/257
9,490,590 B2 * 11/2016 Pari ..... H01R 13/6683
9,673,503 B1 * 6/2017 Aster ..... H01P 5/12
2004/0014350 A1 * 1/2004 McMullen ..... H01R 13/6277 439/350
2007/0212922 A1 9/2007 Montena et al.
2009/0148104 A1 * 6/2009 Lu ..... G02B 6/3816 385/72
2009/0275226 A1 * 11/2009 Chen ..... H01R 13/5202 439/271
2010/0304598 A1 * 12/2010 Kari ..... H01R 13/6277 439/352
2012/0064764 A1 * 3/2012 Islam ..... H01R 9/0521 439/578
2012/0252282 A1 10/2012 Maki
2013/0109210 A1 * 5/2013 Zhang ..... H01R 13/6275 439/271

* cited by examiner

COAXIAL CONNECTOR WITH QUICK LOCKING AND SEPARATING MECHANISM

RELATED APPLICATIONS

This application is a continuation of and claims priority to U.S. application Ser. No. 15/098,987 filed Apr. 14, 2016, now U.S. Pat. No. 9,893,466, which claims priority from Chinese Application No. 201510175690.9 filed Apr. 14, 2015, the disclosure of which is hereby incorporated herein in its entirety.

FIELD OF THE INVENTION

The present invention relates to a coaxial connector, and in particular, to a coaxial connector with a quick locking and separating mechanism.

BACKGROUND OF THE INVENTION

Coaxial connectors, especially radio frequency coaxial connectors are widely used in various industries. Locking and separating mechanisms of the coaxial connectors are very important for the butt joint reliability and applicability of the coaxial connectors. The coaxial connectors in the prior art are usually connected in a threaded connection locking manner, although the reliability of this connection manner is relatively high, such a connection manner has the shortcomings of slow connection and separation speed and large occupied space, and moreover, the coaxial connectors need to be spaced apart for a predetermined distance, so as to the enable the use of corresponding mounting tools. Therefore, these coaxial connectors adopting the threaded connection locking manner in the prior art cannot be installed in high density.

SUMMARY OF THE INVENTION

To overcome or at least relieve the shortcomings of the coaxial connectors in the prior art, the present invention provides a coaxial connector with a quick locking and separating mechanism. The coaxial connector comprises:

a first joint and a second joint, wherein a locking flange is arranged at one end portion of the second joint; and a quick locking and separating mechanism, wherein the quick locking and separating mechanism is used for quickly connecting and separating the first joint and the second joint;

wherein, the quick locking and separating mechanism comprises:

a locking member, wherein the locking member is fixedly arranged on a first end portion of the first joint and is provided with a depression for accommodating the locking flange of the second joint; and a sliding sleeve, wherein the sliding sleeve is arranged around the first joint and can slide between a locking position and an unlocking position, and wherein at the locking position, the sliding sleeve locks the locking flange of the second joint in the depression of the locking member, so as to connect the first joint and the second joint; and at the unlocking position, the sliding sleeve allows the locking flange of the second joint to disengage from the depression of the locking member, so as to permit the first joint to be separated from the second joint.

Preferably, according to a first aspect of the present invention, the locking member is a closed locking ring, and the closed locking ring comprises: a first connecting portion, wherein the first connecting portion is fixedly arranged on the first end portion of the first joint; a radial extension, wherein the radial extension extends outwards from an end portion of the first connecting portion along a radial direction; and at least one elastic claw, wherein the at least one elastic claw extends from the radial extension along an axial direction parallel to the first joint and forms, together with the radial extension, the depression for accommodating the locking flange of the second joint, and an end portion of the elastic claw distal from the radial extension is provided with a radial locking portion which extends inwards and outwards along the radial direction; and wherein, at the locking position of the sliding sleeve, the radial locking portion of the elastic claw abuts against a projection arranged on an inner circumferential surface of the sliding sleeve, so as to prevent the elastic claw from elastically deforming outwards along the radial direction, and accordingly, the locking flange of the second joint is locked in the depression so as to connect the first joint and the second joint; and at the unlocking position of the sliding sleeve, the projection on the inner circumferential surface of the sliding sleeve does not abut against the radial locking portion of the elastic claw, so as to allow the elastic claw to elastically deform outwards along the radial direction, and accordingly, the locking flange of the second joint is allowed to disengage from the depression to permit the first joint to be separated from the second joint.

According to a second aspect of the present invention, the locking member is a C-shaped elastic locking ring. The C-shaped elastic locking ring comprises: a first radial extension, wherein the first radial extension can be inserted into a slot arranged on an outer circumferential surface of the first joint and can carry out radial expansion and contraction movements in the slot; an axial extension which extends from a radial outer end portion of the first radial extension; and a second radial extension which extends from an end portion of the axial extension distal from the first radial extension along a radial inward direction, wherein the second radial extension and the axial extension form the depression used for accommodating the locking flange of the second joint;

wherein, at the locking position of the sliding sleeve, the axial extension abuts against a projection arranged on the inner circumferential surface of the sliding sleeve, so as to compress the C-shaped elastic locking ring inwards along the radial direction due to the stress exerted on its an axial beveled surface, and accordingly, the locking flange of the second joint is locked in the depression so as to connect the first joint and the second joint; and at the unlocking position of the sliding sleeve, the projection on the inner circumferential surface of the sliding sleeve does not abut against the axial extension, so as to allow the C-shaped elastic locking ring to elastically deform outwards along the radial direction to restore its initial shape, when the C-shaped elastic locking ring deforms outwards and restores its initial shape, the first radial extension expands, but is still inserted in the slot, meanwhile, the second radial extension expands to enable the locking flange of the second joint to disengage, and accordingly, the locking flange of the second joint is allowed to disengage from the depression to permit the first joint to be separated from the second joint.

According to the above first aspect of the present invention, preferably, the quick locking and separating mechanism is further provided with at least one pair of springs, each pair of springs acts on the sliding sleeve along opposite directions in the axial direction, so that the sliding sleeve is consistently kept at the locking position when no external force is applied thereto, and that the sliding of the sliding sleeve along the two opposite directions in the axial direction can arrive at the unlocking position.

According to the above first aspect of the present invention, preferably, the at least one pair of springs are compression springs which push the sliding sleeve along opposite directions in the axial direction.

According to the above first aspect of the present invention, preferably, the closed locking ring comprises at least two elastic claws, and the at least two elastic claws are uniformly distributed along the circumference of the closed locking ring.

According to the above first aspect of the present invention, preferably, at least one of the adjoining surfaces of the radial locking portion of the elastic claw and the locking flange of the second joint is a beveled surface, so as to conveniently separate the locking flange of the second joint from the radial locking portion of the elastic claw.

According to the above first aspect of the present invention, preferably, both the adjoining surfaces of the radial locking portion of the elastic claw and the locking flange of the second joint are beveled surfaces.

According to the above first aspect of the present invention, preferably, an outer end portion of the locking flange of the second joint is provided with a beveled surface, in order to push the elastic claw outwards along the radial direction during the initial contact of the locking flange with the radial locking portion of the elastic claw so as to expand the elastic claw when connecting the first joint and the second joint.

According to the above second aspect of the present invention, preferably, a sliding sleeve locating portion is arranged on the outer circumferential surface of the axial extension of the C-shaped elastic locking ring, a sliding sleeve locating counterpart is arranged on the projection on the inner circumferential surface of the sliding sleeve, when the sliding sleeve is at the locking position, the sliding sleeve locating portion is matched with the sliding sleeve locating counterpart to prevent the sliding sleeve from sliding away from the locking position by a force smaller than a threshold, but allow the sliding sleeve to slide away from the locking position by a force larger than the threshold.

According to the above second aspect of the present invention, preferably, one of the sliding sleeve locating portion and the sliding sleeve locating counterpart is a projection, and another of the sliding sleeve locating portion and the sliding sleeve locating counterpart is a depression.

According to the above second aspect of the present invention, preferably, the C-shaped elastic locking ring is provided with at least one axial notch to reduce the force necessary for compressing the C-shaped elastic locking ring in the radial direction.

According to the above second aspect of the present invention, preferably, the C-shaped elastic locking ring is provided with at least two axial notches uniformly distributed along the circumference of the C-shaped elastic locking ring, in order to reduce the force necessary for compressing the C-shaped elastic locking ring in the radial direction.

According to the above second aspect of the present invention, preferably, one end portion of the projection on the inner circumferential surface of the sliding sleeve is provided with a beveled surface for applying a radial inward force to the C-shaped elastic locking ring, when moving sliding sleeve from the unlocking position to the locking position.

According to the above second aspect of the present invention, preferably, at least one of an outer side end face of the second radial extension of the C-shaped elastic locking ring and an outer side end face of the locking flange of the second joint is provided with a beveled surface, so as to apply a radial outward expansion force to the C-shaped elastic locking ring through the axial movement of the second joint, when inserting the locking flange of the second joint into the depression in the C-shaped elastic locking ring.

According to the above second aspect of the present invention, preferably, at least one of an inner side end face of the second radial extension of the C-shaped elastic locking ring and an inner side end face of the locking flange of the second joint is provided with a beveled surface, so as to apply a radial outward expansion force to the C-shaped elastic locking ring through the axial movement of the second joint, when inserting the locking flange of the second joint into the depression in the C-shaped elastic locking ring.

According to a third aspect of the present invention, preferably, the locking member is a C-shaped elastic locking ring. The C-shaped elastic locking ring comprises: a radial extension, wherein the radial extension is arranged in a groove in a first end portion of the first joint; an axial extension, wherein the axial extension extends along the axial direction from the radial extension; and a locking projection, wherein the locking projection is arranged on an end portion of the axial extension distal from the radial extension and protrudes inwards and outwards along the radial direction, and the locking projection forms, together with the radial extension and the axial extension, the depression used for accommodating the locking flange of the second joint; wherein, at the locking position of the sliding sleeve, the locking projection abuts against a projection arranged on the inner circumferential surface of the sliding sleeve, so as to prevent the C-shaped elastic locking ring from expanding outwards along the radial direction, and accordingly, the locking flange of the second joint is locked in the depression so as to connect the first joint and the second joint; and at the unlocking position of the sliding sleeve, the projection on the inner circumferential surface of the sliding sleeve does not abut against the locking projection, so as to allow the C-shaped elastic locking ring to elastically deform outwards along the radial direction, and accordingly, the locking flange of the second joint is allowed to disengage from the depression so as to permit the first joint to be separated from the second joint.

According to the above third aspect of the present invention, preferably, at least one of the adjoining surfaces of the locking projection and the locking flange of the second joint is a beveled surface, so as to facilitate the separation of the locking flange of the second joint from the locking projection.

According to the above third aspect of the present invention, preferably, both the adjoining surfaces of the locking projection and the locking flange of the second joint are beveled surfaces.

According to the above third aspect of the present invention, preferably, an outer end portion of the locking flange of the second joint is provided with a beveled surface, in order to push the locking projection outwards along the radial direction during the initial contact of the locking flange with the locking projection to expand the C-shaped elastic locking ring, when connecting the first joint and the second joint.

According to the above third aspect of the present invention, preferably, the quick locking and separating mechanism is further provided with at least one pair of springs, each pair of springs acts on the sliding sleeve along opposite directions in the axial direction, so that the sliding sleeve is consistently kept at the locking position when no external force is applied thereto.

According to the above third aspect of the present invention, preferably, a spring abutting portion is arranged on the outer circumferential surface of the first joint, adjacent end portions of each pair of springs abut against both sides of the spring abutting portion, and end portions of each pair of springs distal from each other abut against both ends of the sliding sleeve, accordingly, each pair of springs acts on the sliding sleeve along opposite directions in the axial direction, so that the sliding sleeve is consistently kept at the locking position when no external force is applied thereto.

According to the above third aspect of the present invention, preferably, the at least one pair of springs are compression springs which push the sliding sleeve along opposite directions in the axial direction.

The coaxial connector according to the above first aspect, second aspect and third aspect of the present invention can be used as a radio frequency coaxial connector.

In addition, in the coaxial connector according to the above first aspect, second aspect and third aspect of the present invention, the second joint can be a standard 4.3/10.0 female connector.

The coaxial connector of the present invention is simple in structure and easy to manufacture, so that the manufacturing cost of the coaxial connector is reduced. The connection and separation of the coaxial connector of the present invention are simple and reliable, no additional tool kit is required. The coaxial connector of the present invention can also be installed in high density, thereby saving the space.

BRIEF DESCRIPTION OF THE DRAWINGS

Preferred embodiments of the present invention will be described below in more detail with reference to the accompanying drawings, wherein.

DETAILED DESCRIPTION OF THE EMBODIMENTS

Figure 1:
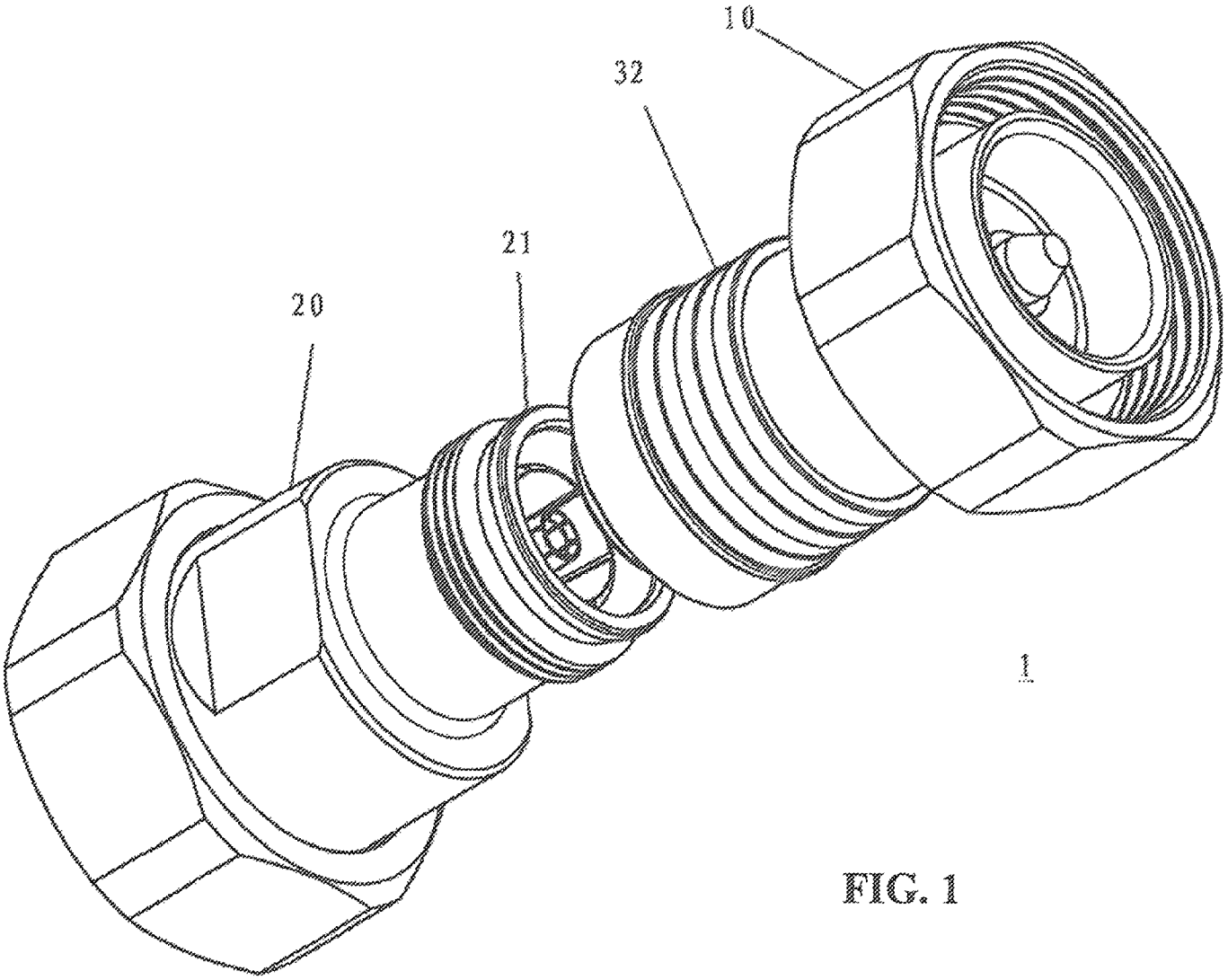
FIG. 1 is a perspective view of a coaxial connector according to a first embodiment of the present invention, wherein the first joint and the second joint are in a separated state.

FIG. 1 to FIG. 7B show a coaxial connector 1 with a quick locking and separating mechanism according to a first embodiment of the present invention. The coaxial connector 1 comprises a first joint 10 and a second joint 20, and a locking flange 21 is arranged at one end portion of the second joint 20. The coaxial connector 1 further comprises a quick locking and separating mechanism 30 (see FIG. 2) used for quickly connecting and separating the first joint 10 and the second joint 20.

Figure 2:
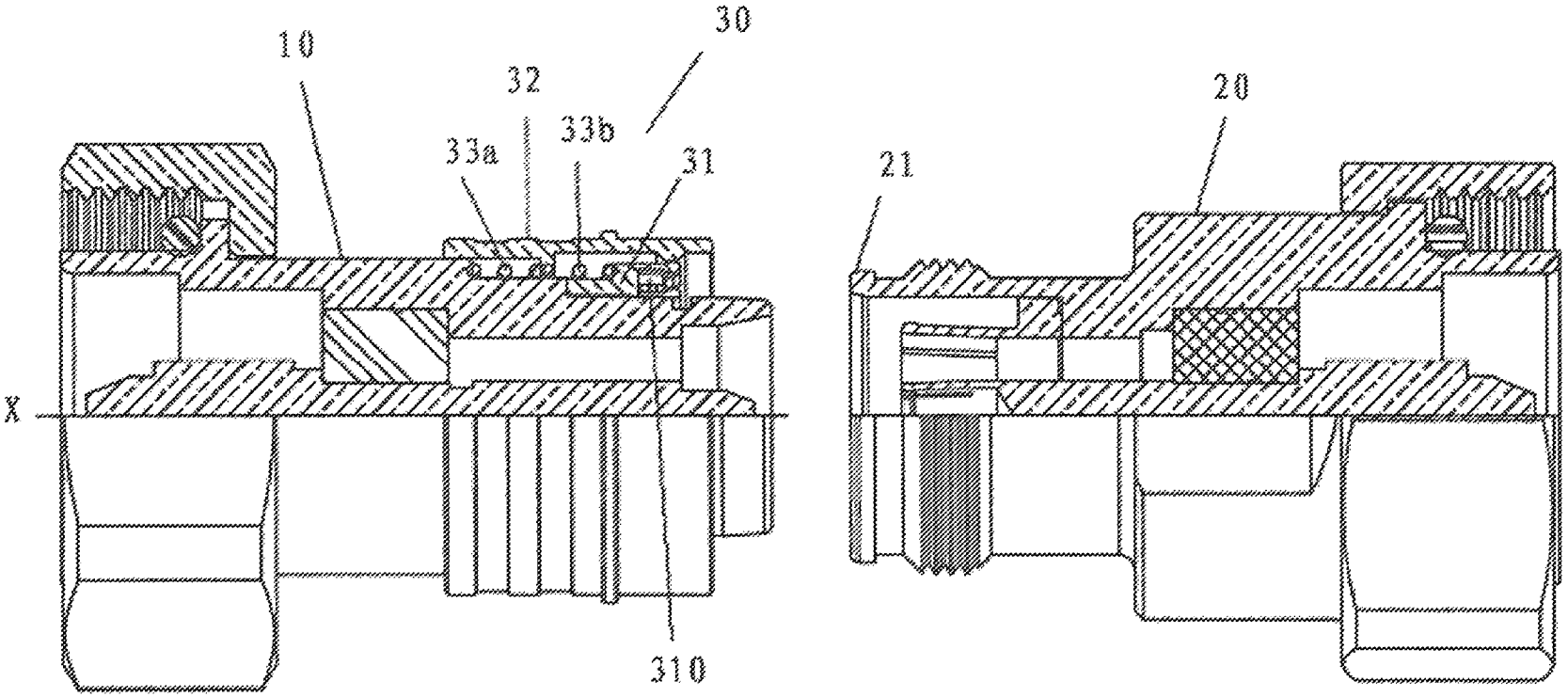
FIG. 2 is a partial section view of the coaxial connector according to the first embodiment of the present invention, wherein the first joint and the second joint are in the separated state.

As shown in FIG. 2, the quick locking and separating mechanism 30 comprises a closed locking ring 31, the closed locking ring 31 is fixed on an end portion of the first joint 10, and is provided with a depression 310 used for accommodating the locking flange 21 of the second joint 20. The quick locking and separating mechanism 30 further comprises a sliding sleeve 32, and the sliding sleeve 32 is disposed around the first joint 10 and can slide between a locking position and an unlocking position. At the locking position (see FIG. 6), the sliding sleeve 32 locks the locking flange 21 of the second joint 20 in the depression 310 of the closed locking ring 31, so as to connect the first joint 10 and the second joint 20. At the unlocking position (see FIG. 7A and FIG. 7B), the sliding sleeve 32 allows the locking flange 21 of the second joint 20 to disengage from the depression 310 of the closed locking ring 31, so as to permit the first joint 10 to be separated from the second joint 20.

Figure 3:
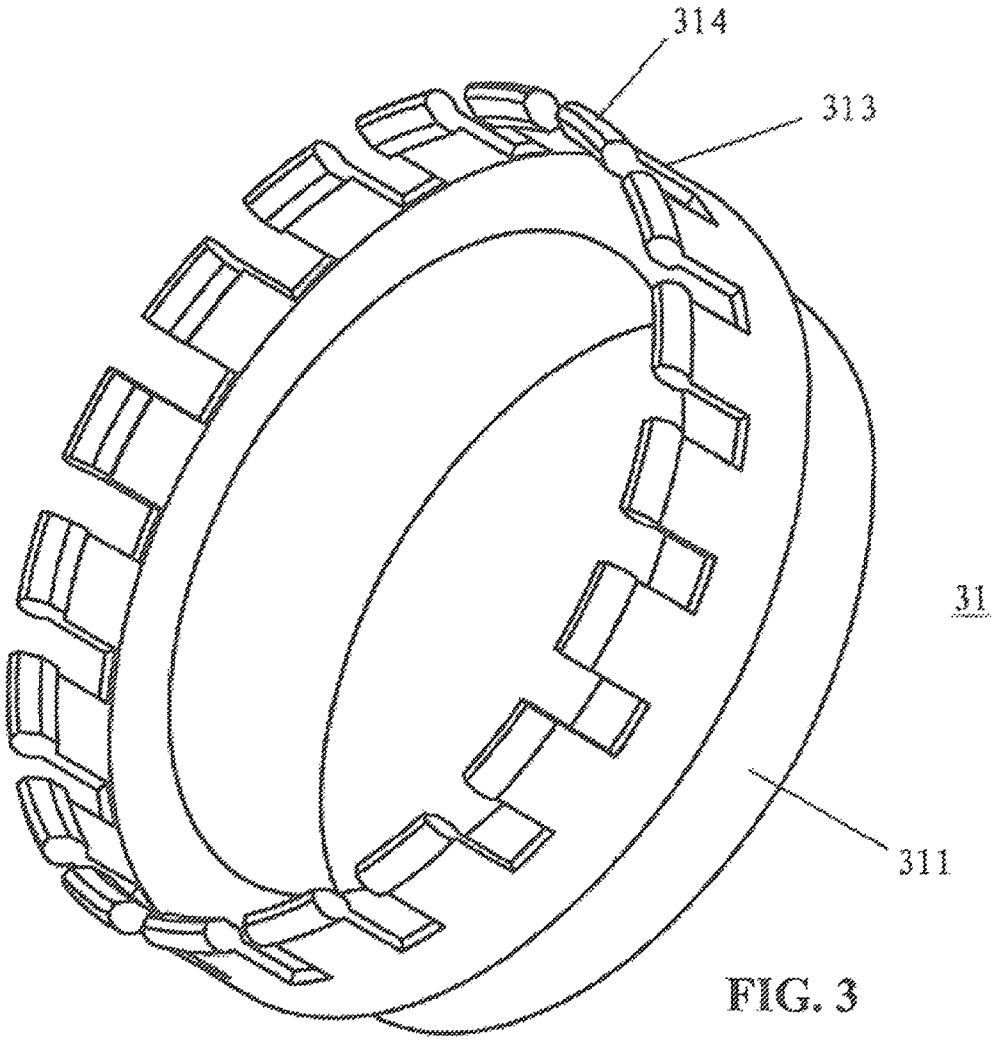
FIG. 3 is a perspective view of a locking member of the coaxial connector according to the first embodiment of the present invention.
Figure 4:
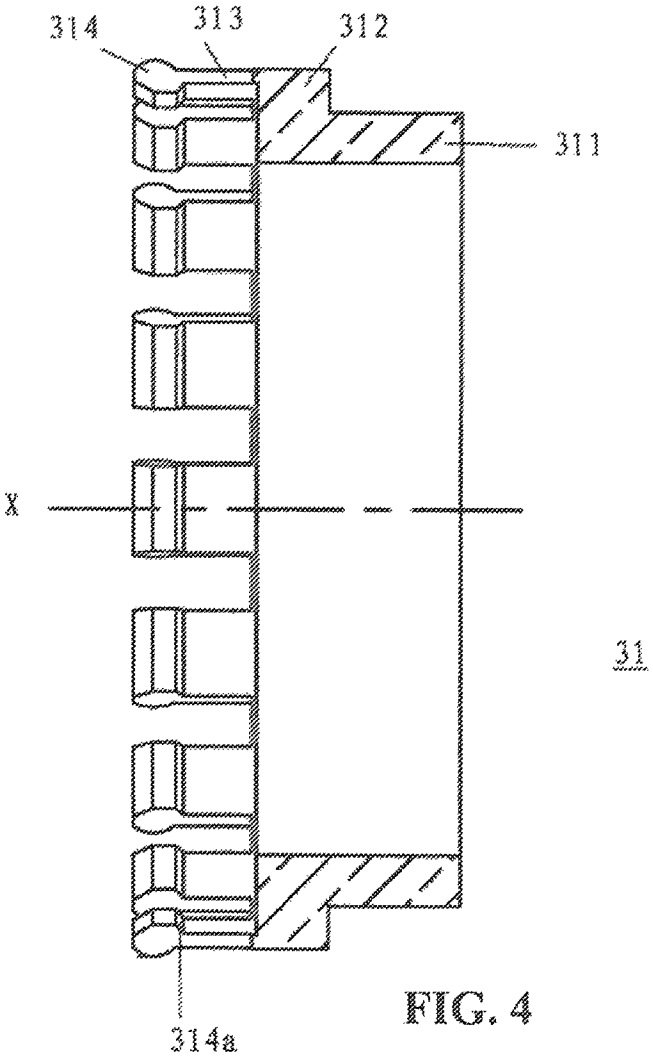
FIG. 4 is a section view of the locking member of the coaxial connector according to the first embodiment of the present invention.
Figure 5:
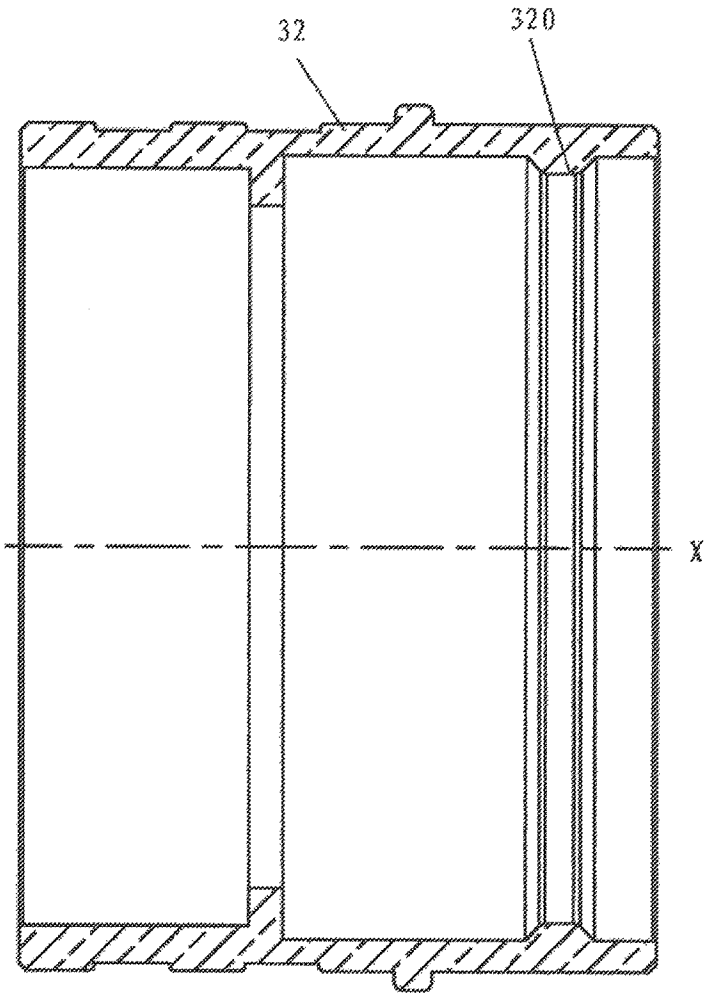
FIG. 5 is a section view of a sliding sleeve of the coaxial connector according to the first embodiment of the present invention.
Figure 6:
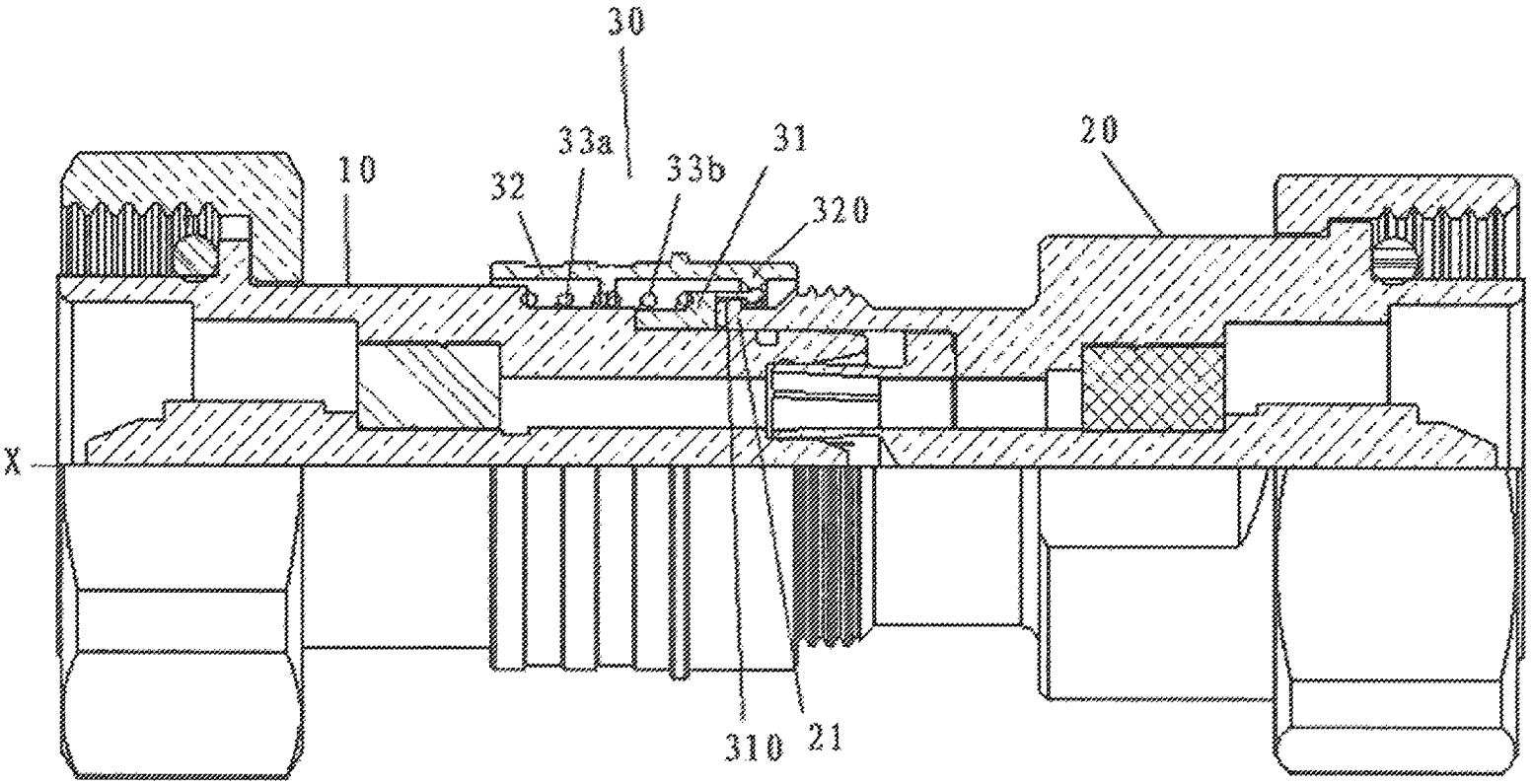
FIG. 6 is a partial section view of the coaxial connector according to the first embodiment of the present invention, wherein the first joint and the second joint are in a locking state, and the locking sleeve is at a locking position.

As shown in FIG. 3 and FIG. 4, the closed locking ring 31 comprises: a first connecting portion 311 fixed on the first joint 10; a radial extension 312 extending outwards from an end portion of the first connecting portion 311 along a radial direction; and a plurality of elastic claws 313, the plurality of elastic claws 313 extend from the radial extension 312 along an axial direction X parallel to the first joint 10 and form together with the radial extension 312 the depression 310 used for accommodating the locking flange 21 of the second joint 20, and the elastic claw 313 is provided an end portion thereof distal from the radial extension 312 with a radial locking portion 314 which extends inwards and outwards along the radial direction. As shown in the figures, the plurality of elastic claws 313 are uniformly distributed along a circumference so as to apply a uniformly distributed locking function on the locking flange 21 of the second joint 20. In addition, although it is shown in the figures that the plurality of elastic claws 313 are arranged, it can be conceived that only one or two elastic claws 313 can also be arranged, as long as a sufficient locking function can be achieved.

At the locking position of the sliding sleeve 32, the radial locking portion 314 of the elastic claw 313 abuts against a projection 320 on an inner circumferential surface of the sliding sleeve 32, so as to prevent the elastic claw 313 from elastically deforming outwards along the radial direction, and accordingly, the locking flange 21 of the second joint 20 is locked in the depression 310 so as to connect the first joint 10 and the second joint 20.

Figure 7A:
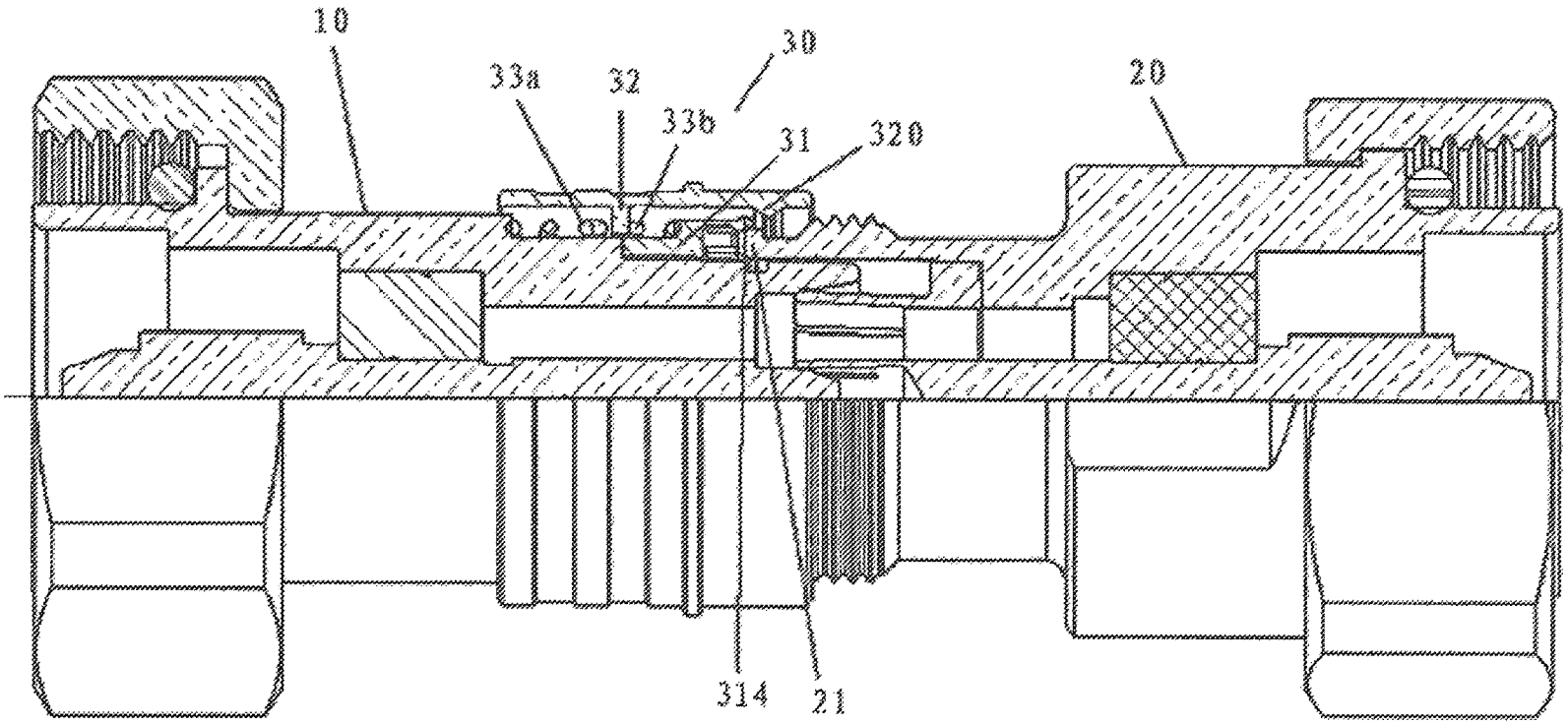
FIG. 7A and FIG. 7B are diagrams showing inserting and locking processes of the locking sleeve.
Figure 7B:
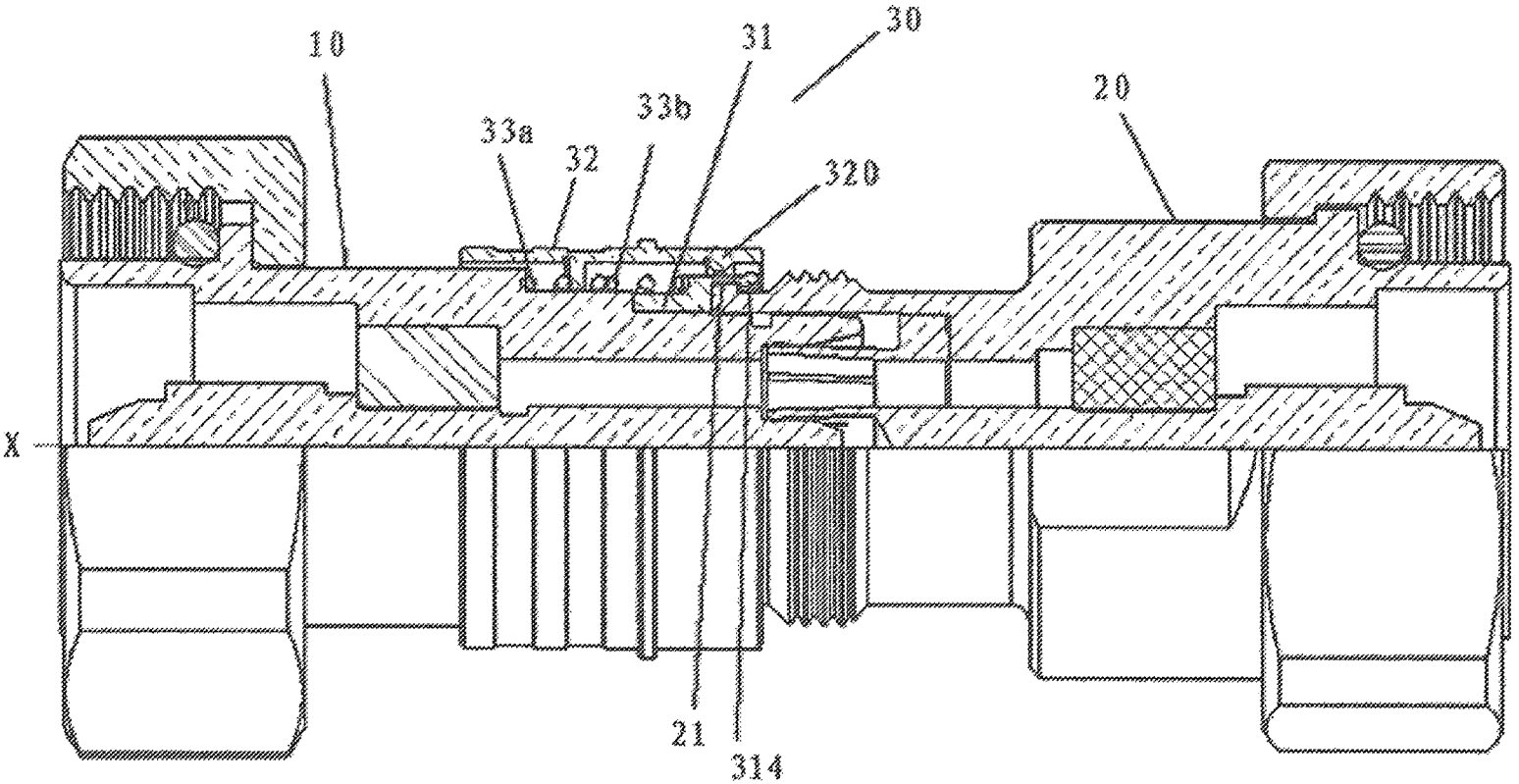
Figure 8:
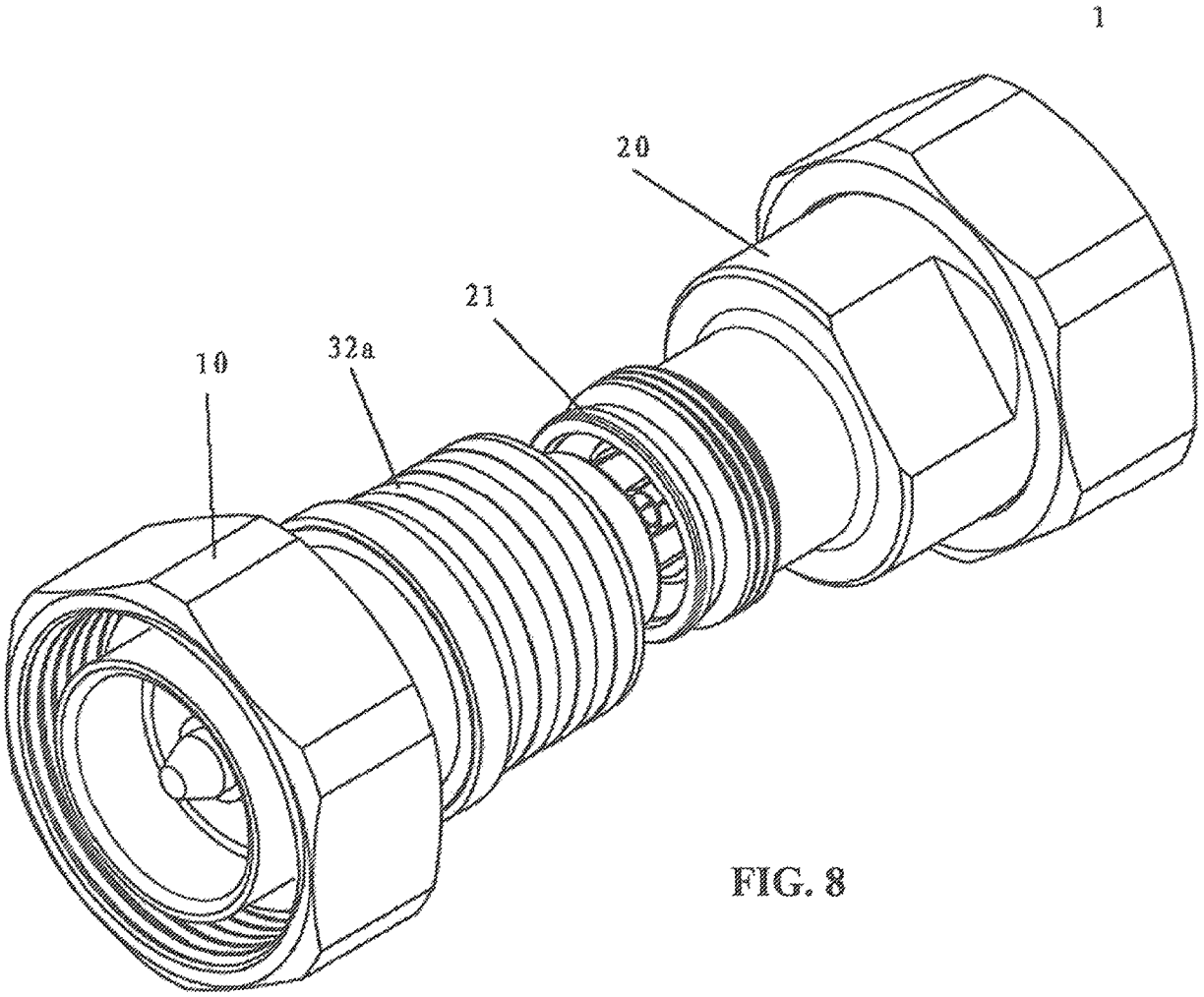
FIG. 8 is a perspective view of a coaxial connector according to a second embodiment of the present invention, wherein the first joint and the second joint are in a separated state.

As shown in FIG. 2, FIG. 6, FIG. 7A and FIG. 7B, the quick locking and separating mechanism 30 further comprises a pair of springs 33*a* and 33*b*, the springs 33*a* and 33*b* act on the sliding sleeve 32 along opposite directions in the axial direction X, so that the sliding sleeve 32 is consistently kept at the locking position (see FIG. 2 and FIG. 6) when no external force is applied thereto, and that the sliding of the sliding sleeve 32 along the two opposite directions in the axial direction X can arrive at the unlocking position (see FIG. 7A and FIG. 7B). Although only one pair of springs 33*a* and 33*b* is shown in the figures, it could be conceived by those skilled in the art that two or more pairs of springs can also be arranged according to a force to be provided.

In the first embodiment according to the present invention, preferably, the pair of springs 33*a* and 33*b* is compression springs which push the sliding sleeve 32 along opposite directions in the axial direction X.

FIG. 7A and FIG. 7B show two unlocking positions of the sliding sleeve 32. In the two unlocking positions as shown in FIG. 7A and FIG. 7B, the projection 320 on the inner circumferential surface of the sliding sleeve 32 does not abut against the radial locking portion 314 of the elastic claw 313, so as to allow the elastic claw 313 to elastically deform outwards along the radial direction, and accordingly, the locking flange 21 of the second joint 20 is allowed to disengage from the depression 310 to permit the first joint 10 to be separated from the second joint 20.

In the first embodiment according to the present invention, preferably, a surface 314*a* of the radial locking portion 314 of the elastic claw 313 adjoined with the locking flange 21 of the second joint 20 is a beveled surface (see FIG. 4), so as to facilitate the separating of the locking flange 21 of the second joint 20 from the radial locking portion 314 of the elastic claw 313.

In addition, in the first embodiment according to the present invention, more preferably, an outer side end face of the locking flange 21 of the second joint 20 is chamfered or rounded to push the elastic claw 313 outwards along the radial direction during the initial contact of the locking flange 21 with the radial locking portion 314 of the elastic claw 313 when connecting the first joint 10 and the second joint 20, in order to force the elastic claw 313 to expand outwards.

Connection and separation operations of the coaxial connector 1 according to the first embodiment of the present invention will be described below.

When connecting the first joint 10 and the second joint, at first, the sliding sleeve 30 is moved to the unlocking position as shown in FIG. 7A or FIG. 7B along the axial direction X. Accordingly, the projection 320 on the inner circumferential surface of the sliding sleeve 30 disengage from the radial locking portion 314 of the elastic claw 313 to allow the elastic claw 313 to expand outwards along the radial direction. Then, while keeping the sliding sleeve 30 at the unlocking position as shown in FIG. 7A or FIG. 7B, the second joint 20 is pushed onto the first joint 10, so that the locking flange 21 of the second joint 20 initially contacts the radial locking portion 314 of the elastic claw 313. The outer side end face of the locking flange 21 is a beveled surface, so along with further pushing the second joint 20 towards the first joint 10, the locking flange 21 will push the radial locking portion 314 of the elastic claw 313 outwards, and accordingly, the elastic claw expands outwards along the radial direction to allow the locking flange 21 to enter the depression 310 of the closed locking ring 31. After the locking flange 21 enters the depression 310 of the closed locking ring 31, the elastic claw 313 will automatically restore to an initial state thereof. At this time, the sliding sleeve 30 is released, under the push of the springs 33*a* and 33*b*, the sliding sleeve 30 will automatically return to the locking position. At the locking position, the projection 320 on the inner circumferential surface of the sliding sleeve 30 abuts against the radial locking portion 314 of the elastic claw 313, so as to prevent the elastic claw 313 from expanding outwards along the radial direction, and accordingly, the locking flange 21 of the second joint 20 is locked in the depression 310 of the closed locking ring 31 so as to connect the first joint 10 and the second joint 20.

When separating the first joint 10 and the second joint 20, at first, the sliding sleeve 30 is moved to the unlocking position as shown in FIG. 7A or FIG. 7B along the axial direction X, accordingly, the projection 320 on the inner circumferential surface of the sliding sleeve 30 disengages from the radial locking portion 314 of the elastic claw 313 to allow the elastic claw 313 to expand outwards along the radial direction. Then, while keeping the sliding sleeve 30 at the unlocking position as shown in FIG. 7A or FIG. 7B, the second joint 20 is pulled outwards, and since the surface 314*a* of the radial locking portion 314 of the elastic claw 313 adjoined with the locking flange 21 of the second joint 20 is a beveled surface (see FIG. 4), the movement of the locking flange 21 of the second joint 20 away from the first joint 10 will apply a radial outward force to the surface 314*a* to force the elastic claw 313 to elastically deform outwards along the radial direction, so as to allow the locking flange of the second joint 20 to disengage from the depression 310 of the closed locking ring 31 so as to permit the first joint 10 to be separated from the second joint 20.

The coaxial connector 1 with the quick locking and separating mechanism according to the first embodiment of the present invention can achieve quick unlocking and quick separation without requiring any additional tool at all. In addition, the pair of springs 33*a* and 33*b* acting on the sliding sleeve 30 along the opposite directions is arranged, therefore, when no external force is applied to the sliding sleeve 30, the sliding sleeve 30 is reliably located at the locking position all the time under the action of the pair of springs 33*a* and 33*b*, so that the first joint 10 can be reliably prevented from being separated from the second joint 20. In addition, in the first embodiment according to the present invention, the sliding sleeve 30 has two unlocking positions as shown in FIG. 7A and FIG. 7B, the first joint 10 and the second joint 20 can be easily separated at any unlocking position, and thus a more flexible unlocking manner is provided.

A coaxial connector according to a second embodiment of the present invention will be described below with reference to FIG. 8 to FIG. 12. The difference between the coaxial connector in the second embodiment of the present invention and the coaxial connector in the first embodiment of the present invention only lies in the quick locking and separating mechanism. Therefore, in FIG. 8 to FIG. 12, components in the second embodiment identical or similar to those in the first embodiment are indicated by the same reference signs, and detailed description thereof is omitted. In the following description, a specific quick locking and separating mechanism 30*a* of the second embodiment will be described in detail.

Figure 9:
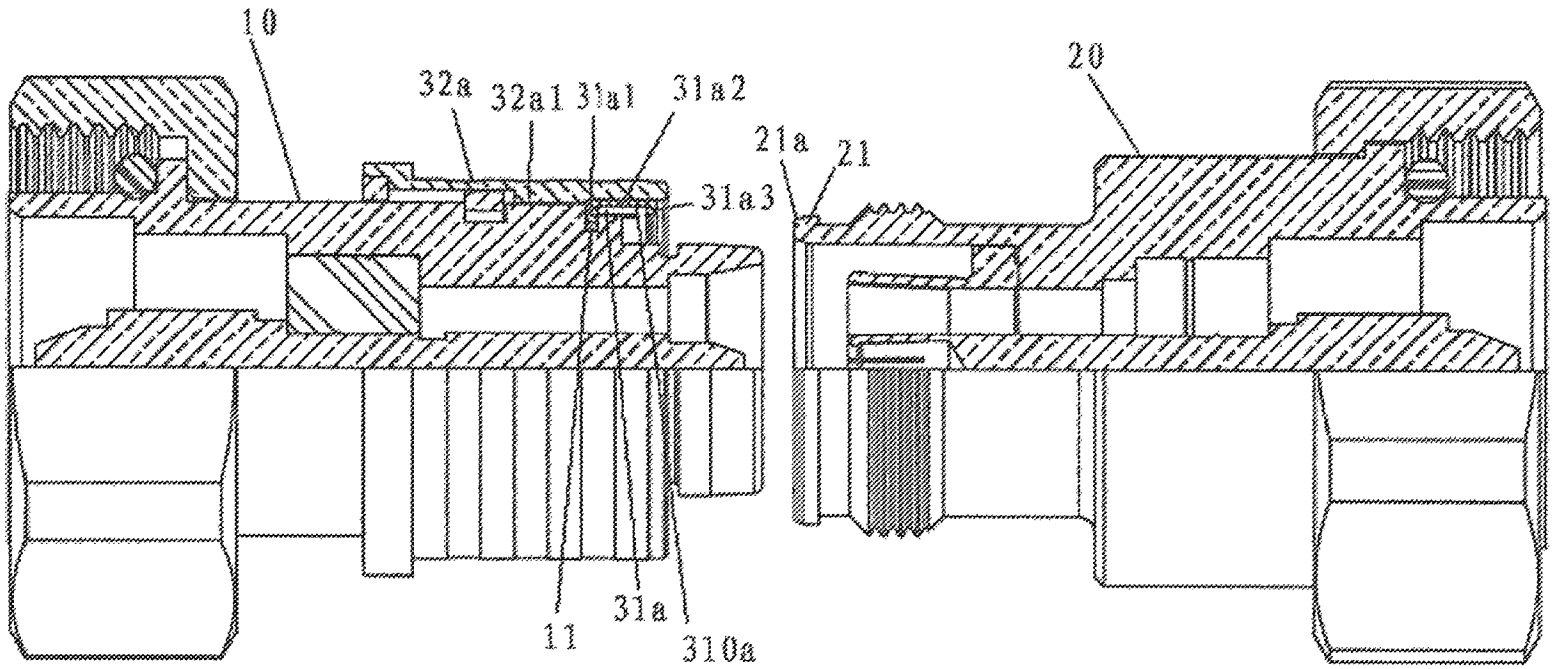
FIG. 9 is a partial section view of the coaxial connector according to the second embodiment of the present invention, wherein the first joint and the second joint are in the separated state.

As shown in FIG. 8 to FIG. 12, in the second embodiment of the present invention, the quick locking and separating mechanism 30*a* comprises a C-shaped elastic locking ring 31*a*. As shown in FIG. 9, FIG. 10A and FIG. 10B, the C-shaped elastic locking ring 31*a* comprises: a first radial extension 31*a*1, wherein the first radial extension 31*a*1 can be inserted into a slot 11 arranged on the outer circumferential surface of the first joint 10 and is movable in the slot 11; an axial extension 31*a*2 which extends from a radial outer end portion of the first radial extension 31*a*1; and a second radial extension 31*a*3 which extends from an end portion of the axial extension 31*a*2 distal from the first radial extension 31*a*1 along a radial inward direction, wherein the second radial extension 31*a*3 and the axial extension 31*a*2 form a depression 310*a* used for accommodating the locking flange 21 of the second joint 20.

The quick locking and separating mechanism 30*a* further comprises a sliding sleeve 32*a*, and the sliding sleeve 32*a* is arranged around the first joint 10 and can slide between a locking position and an unlocking position. At the locking position (see FIG. 12), the sliding sleeve 32*a* locks the locking flange 21 of the second joint 20 in the depression 310*a* of the C-shaped elastic locking ring 31*a*, so as to connect the first joint 10 and the second joint 20. At the unlocking position (see FIG. 9), the sliding sleeve 32*a* allows the locking flange 21 of the second joint 20 to disengage from the depression 310*a* of the C-shaped elastic locking ring 31*a*, so as to permit the first joint 10 to be separated from the second joint 20.

Specifically, at the locking position of the sliding sleeve 32*a*, the axial extension 31*a*2 of the C-shaped elastic locking ring 31*a* abuts against a projection 32*a*1 arranged on the inner circumferential surface of the sliding sleeve 32*a*, so as to compress the C-shaped elastic locking ring 31*a* inwards along the radial direction, and accordingly, the locking flange 21 of the second joint 20 is locked in the depression 310*a* to connect the first joint 10 and the second joint 20. At the unlocking position of the sliding sleeve 32*a*, the projection 32*a*1 on the inner circumferential surface of the sliding sleeve 32*a* does not abut against the axial extension 31*a*2 of the C-shaped elastic locking ring 31*a*, so as to allow the C-shaped elastic locking ring 31*a* to elastically deform outwards along the radial direction to restore an initial shape thereof (see FIG. 9). When the C-shaped elastic locking ring 31*a* is in the initial shape thereof, the first radial extension 31*a*1 is still inserted in the slot 11, meanwhile, the second radial extension 31*a*3 disengages from the locking flange 21 of the second joint 20, and accordingly, the locking flange 21 of the second joint 20 is allowed to disengage from the depression 310*a*1 to permit the first joint 10 to be separated from the second joint 20.

Figure 9A:
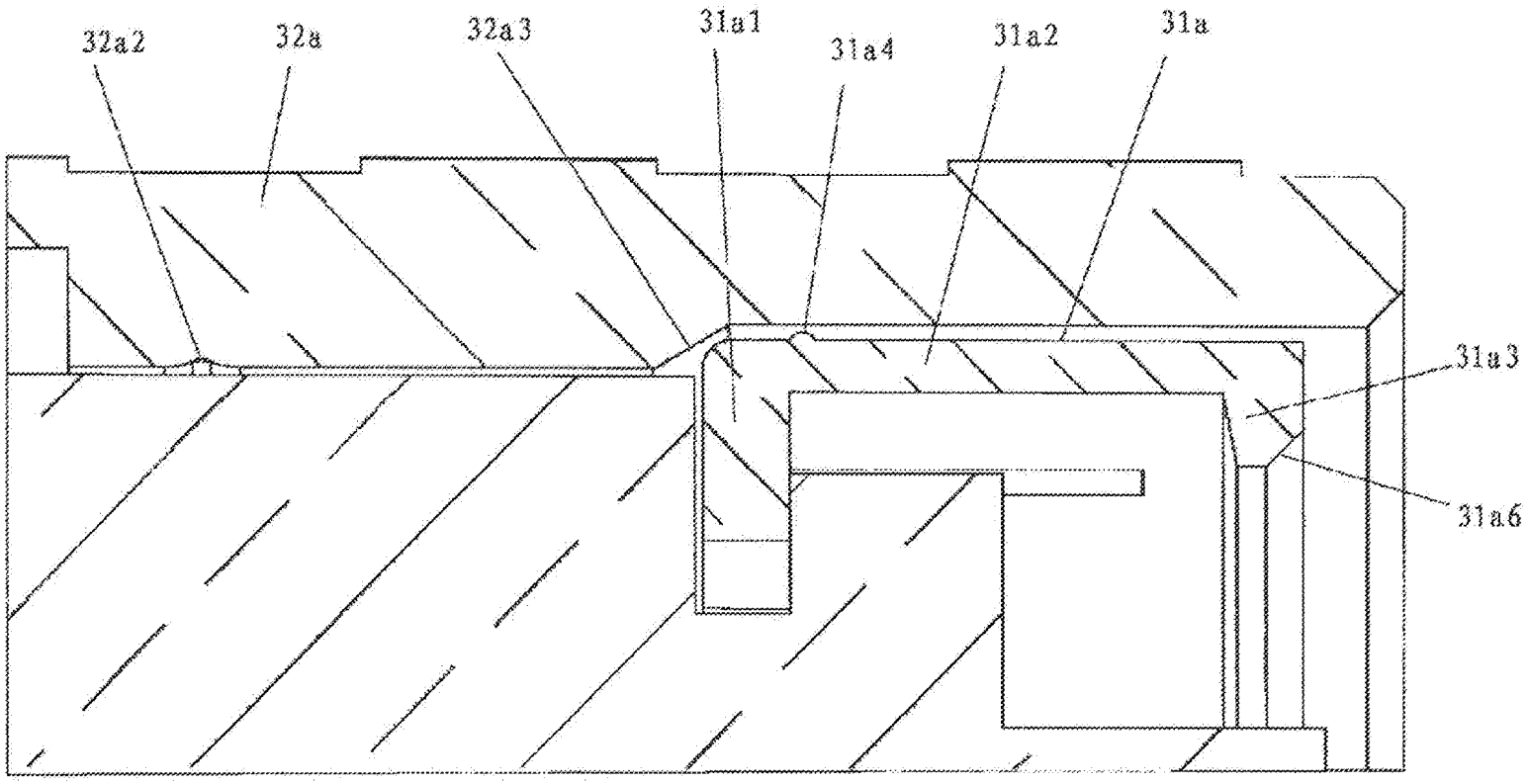
FIG. 9A is a partial enlarged drawing showing the working principle of a C-shaped elastic locking ring shown in FIG. 9.
Figure 10A:
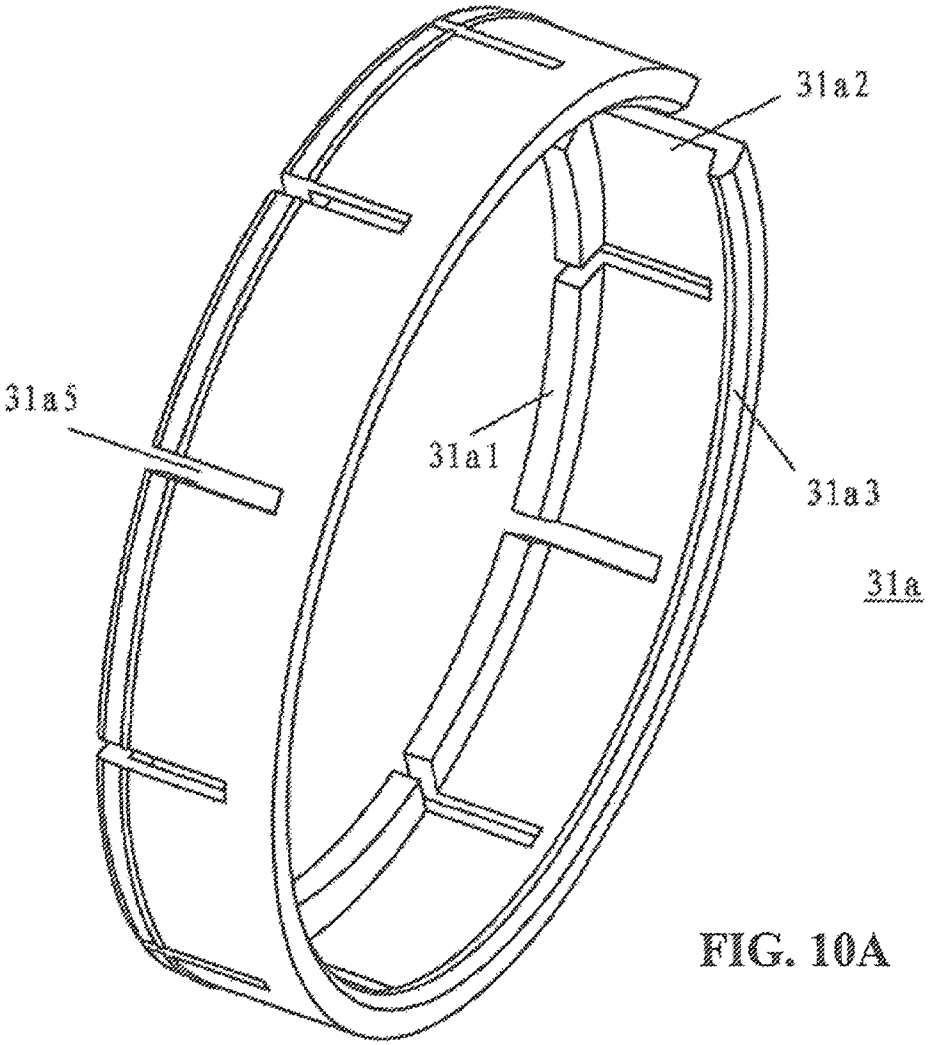
FIG. 10A and FIG. 10B are perspective views of the locking member of the coaxial connector according to the second embodiment of the present invention.
Figure 10B:
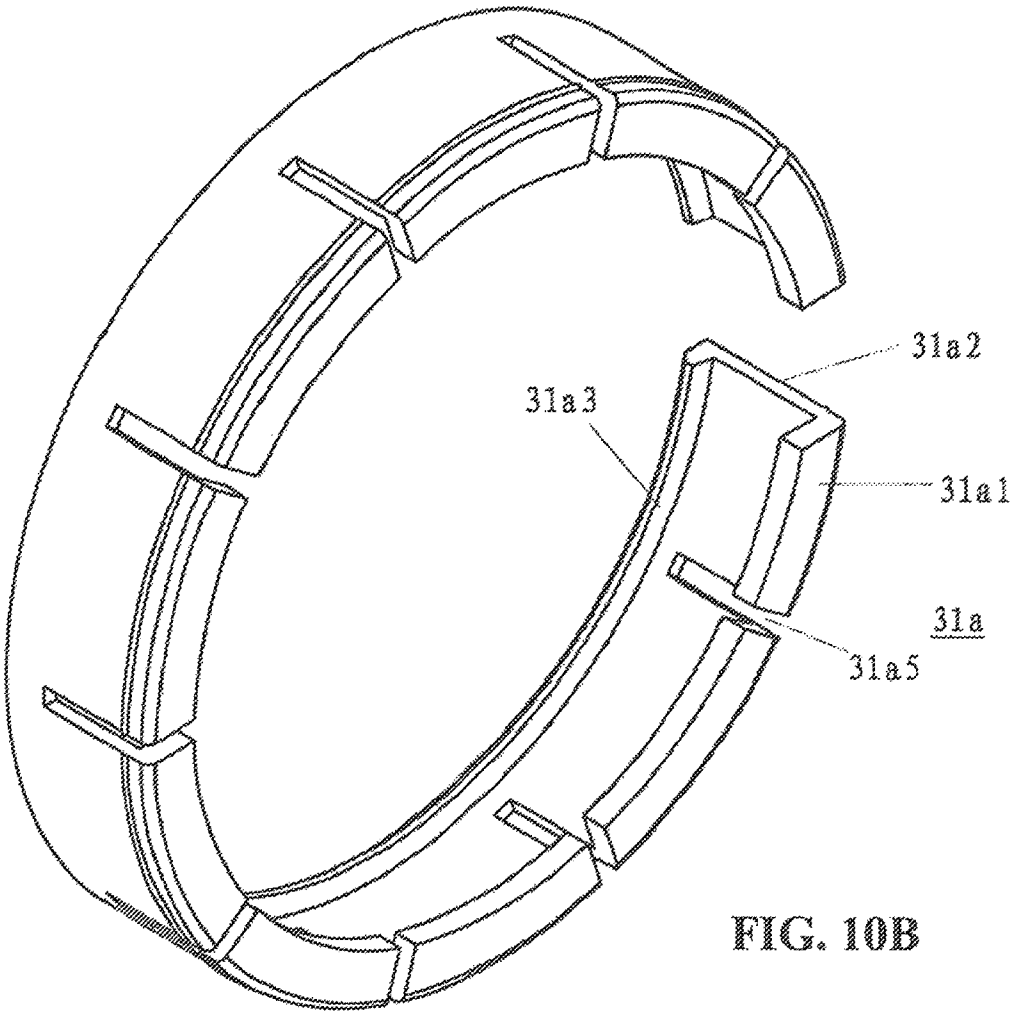
Figure 11:
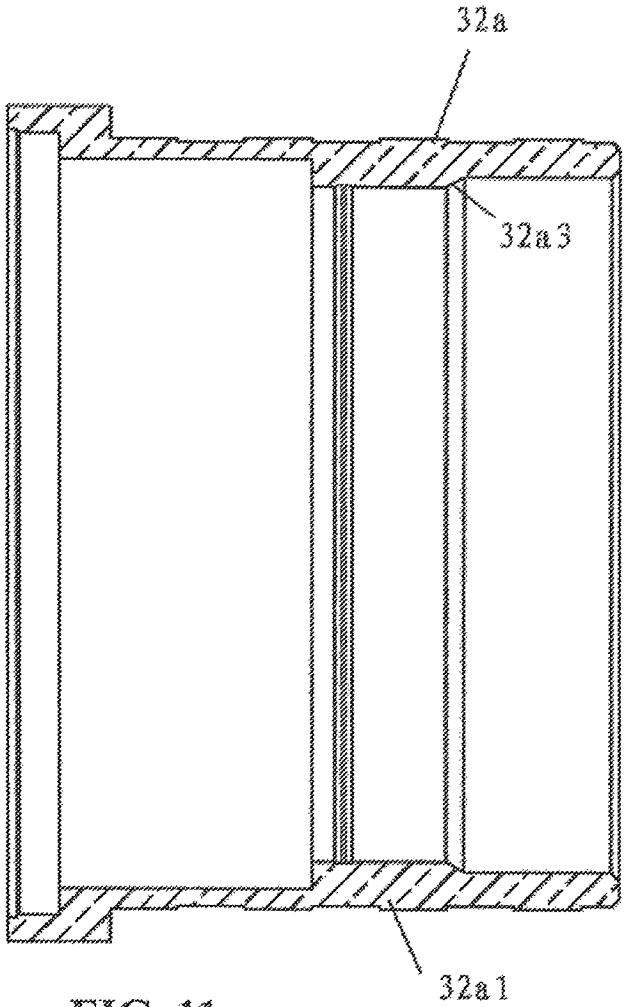
FIG. 11 is a section view of the sliding sleeve of the coaxial connector according to the second embodiment of the present invention.

As shown in FIG. 9A, a sliding sleeve locating projection 31*a*4 is arranged on the outer circumferential surface of the axial extension 31*a*2 of the C-shaped elastic locking ring 31*a*, a sliding sleeve locating depression 32*a*2 is arranged on the projection 32*a*1 on the inner circumferential surface of the sliding sleeve 32*a*; when the sliding sleeve 32*a* is at the locking position (see FIG. 12), the sliding sleeve locating projection 31*a*4 is matched with the sliding sleeve locating depression 32*a*2 to prevent the sliding sleeve 32*a* from sliding away from the locking position by a force smaller than a threshold, but allow the sliding sleeve 32*a* to slide away from the locking position by a force larger than the threshold.

In the second embodiment according to the present invention, preferably, the C-shaped elastic locking ring 31*a* is provided with a plurality of axial notches 31*a*5, which are uniformly distributed along the circumference, to reduce the force necessary for compressing the C-shaped elastic locking ring 31*a* in the radial direction. It should be understood that, the C-shaped elastic locking ring 31*a* can also be provided with only one or two axial notches 31*a*5.

Figure 12:
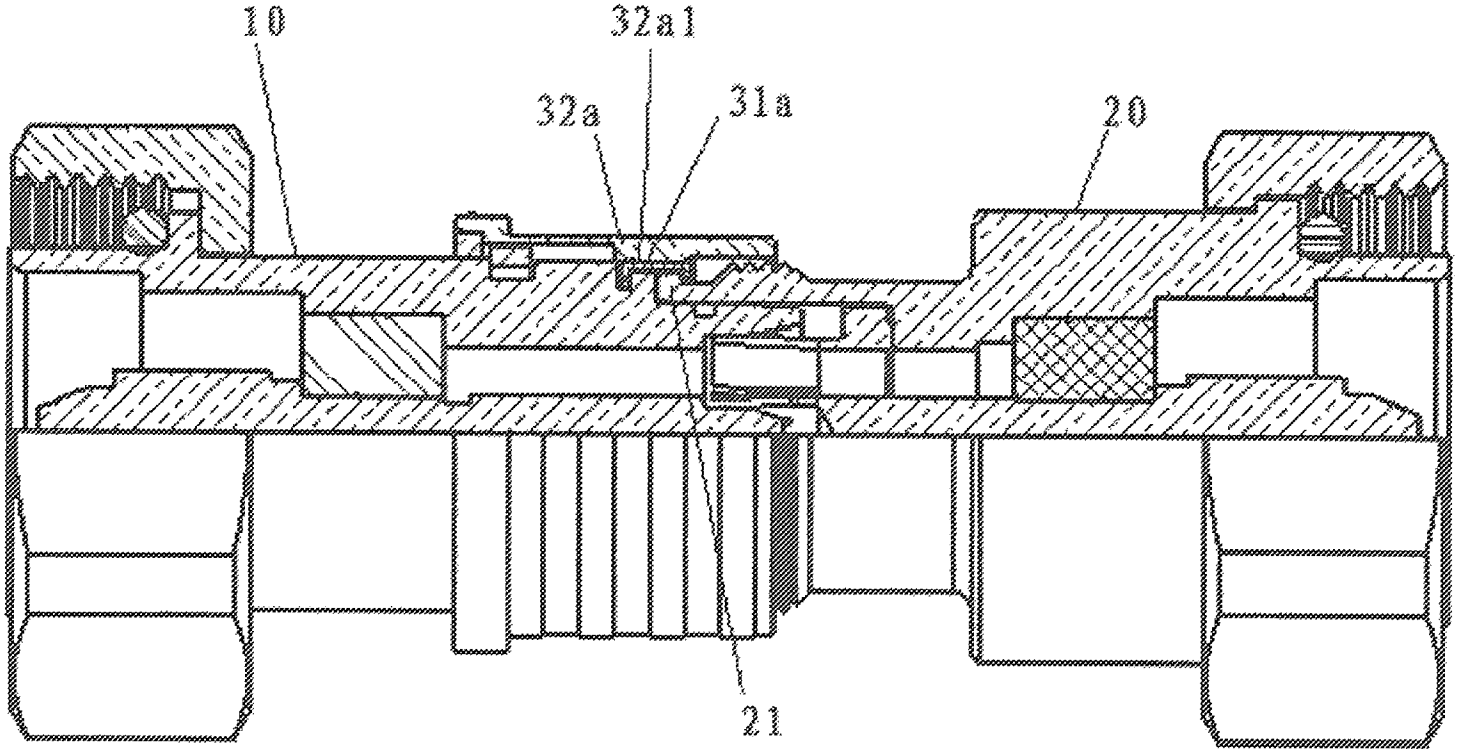
FIG. 12 is a partial section view of the coaxial connector according to the second embodiment of the present invention, wherein the first joint and the second joint are in a locking state, and a locking sleeve is at a locking position.

In the second embodiment according to the present invention, more preferably, an end portion of the projection 32*a*1 on the inner circumferential surface of the sliding sleeve 32*a* is provided with a beveled surface 32*a*3 (see FIG. 9A) for applying a radial inward compression force to the C-shaped elastic locking ring 31*a*, when the sliding sleeve 32*a* moves from the unlocking position as shown in FIG. 9 to the locking position as shown in FIG. 12.

In the second embodiment according to the present invention, more preferably, an outer side end face of the second radial extension 31*a*3 of the C-shaped elastic locking ring 31*a* is provided with a beveled surface 31*a*6 (see FIG. 9A), and the outer side end face of the locking flange 21 of the second joint 20 is provided with a beveled surface 21*a* (see FIG. 9), so as to apply a radial outward expansion force to the C-shaped elastic locking ring 31*a* through the axial movement of the second joint 20, when the locking flange 21 of the second joint 20 is inserted in the depression 310*a* in the C-shaped elastic locking ring 31*a*.

Connection and separation operations of the coaxial connector according to the second embodiment of the present invention will be described below.

When connecting the first joint 10 and the second joint 20, at first, the sliding sleeve 32*a* is moved to the unlocking position as shown in FIG. 9, when the sliding sleeve 32*a* is at the unlocking position, the projection 32*a*1 on the inner circumferential surface of the sliding sleeve 32*a* does not abut against the axial extension 31*a*2 of the C-shaped elastic locking ring 31*a*, so as to allow the C-shaped elastic locking ring 31*a* to elastically expand by the elastic force per se, but due to the limitation of the inner circumferential surface of the sliding sleeve 32*a*, the C-shaped elastic locking ring 31*a* can only expand to a state of approximately abutting against the inner circumferential surface of the sliding sleeve 32*a* by the elastic force per se, and in this state, the first radial extension 31*a*1 is still partially inserted in the slot 11. Then, the second joint 20 is pushed towards the first joint 10, accordingly, the beveled surface 21*a* of the locking flange 21 of the second joint 20 starts to contact the beveled surface 31*a*6 of the second radial extension 31*a*3 of the C-shaped elastic locking ring 31*a*, so that the locking flange 21 forces the C-shaped elastic locking ring 31*a* to further deform along the radial direction. Then, the second joint 20 is further pushed towards the first joint 10 to make the locking flange 21 of the second joint 20 enter the depression 310*a* of the C-shaped elastic locking ring 31*a*. After the locking flange 21 of the second joint 20 enters the depression 310*a* of the C-shaped elastic locking ring 31*a*, the sliding sleeve 32*a* is moved from the unlocking position as shown in FIG. 9 and FIG. 9A to the locking position as shown in FIG. 12, and during moving towards the locking position, the projection 32*a*1 on the inner circumferential surface of the sliding sleeve 32*a* compresses the C-shaped elastic locking ring 31*a* inwards along the radial direction, so as to lock the locking flange 21 of the second joint 20 in the depression 310*a* of the C-shaped elastic locking ring 31*a*. At the locking position as shown in FIG. 12, the projection 32*a*1 on the inner circumferential surface of the sliding sleeve 32*a* abuts against the axial extension 31*a*2 of the C-shaped elastic locking ring 31*a*, so as to prevent the C-shaped elastic locking ring 31*a* from expanding. Moreover, at the locking position as shown in FIG. 12, the sliding sleeve locating projection 31*a*4 on the C-shaped elastic locking ring 31*a* shown in FIG. 9A is located in the sliding sleeve locating depression 32*a*2, to prevent the sliding sleeve 32*a* from sliding away from the locking position by a force smaller than a threshold, but allow the sliding sleeve 32*a* to slide away from the locking position by a force larger than the threshold.

When separating the first joint 10 and the second joint 20, at first, the sliding sleeve 32*a* is moved from the locking position as shown in FIG. 12 to the unlocking position as shown in FIG. 9, accordingly, the projection 32*a*1 on the inner circumferential surface of the sliding sleeve 32*a* does not abut against the axial extension 31*a*2 of the C-shaped elastic locking ring 31*a*, so as to allow the C-shaped elastic locking ring 31*a* to expand. Then, the second joint 20 is pulled outwards to enable the locking flange 21 of the second joint 20 to disengage from the depression 310*a* of the C-shaped elastic locking ring 31*a*, so as to separate the first joint 10 from the second joint 20.

A coaxial connector in a third embodiment of the present invention will be described below with reference to FIG. 13 to FIG. 15. The difference between the coaxial connector in the third embodiment of the present invention and the coaxial connectors in the first embodiment and the second embodiment of the present invention only lies in the quick locking and separating mechanism. Therefore, in FIG. 13 to FIG. 15, components in the third embodiment identical or similar to those in the first embodiment and the second embodiment are indicated by same reference signs, and detailed description thereof is omitted. In the following description, a specific quick locking and separating mechanism 30*b* of the third embodiment will be described in detail.

Figure 13:
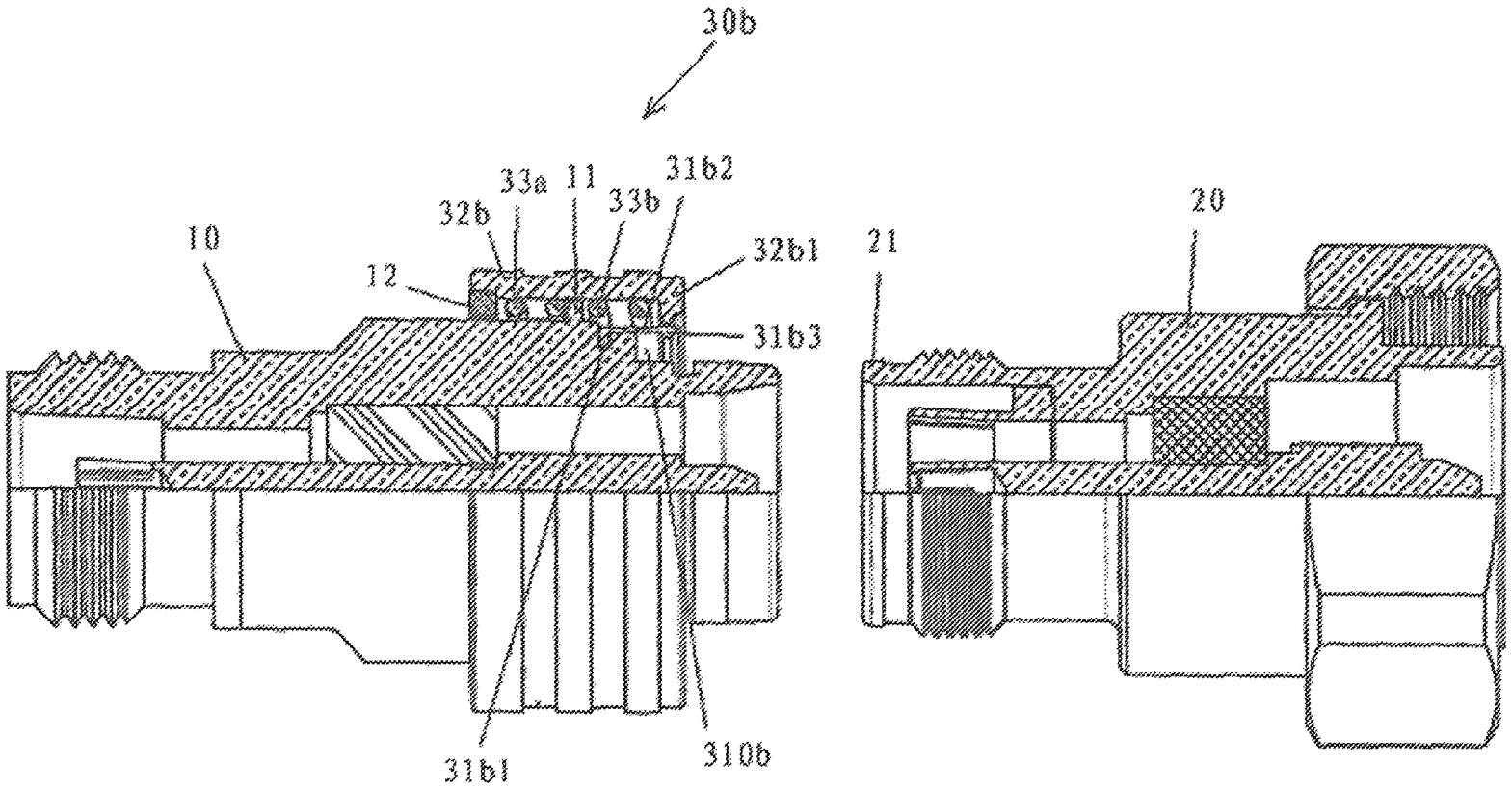
FIG. 13 is a partial section view of a coaxial connector according to a third embodiment of the present invention, wherein the first joint and the second joint are in a separated state.
Figure 14B:
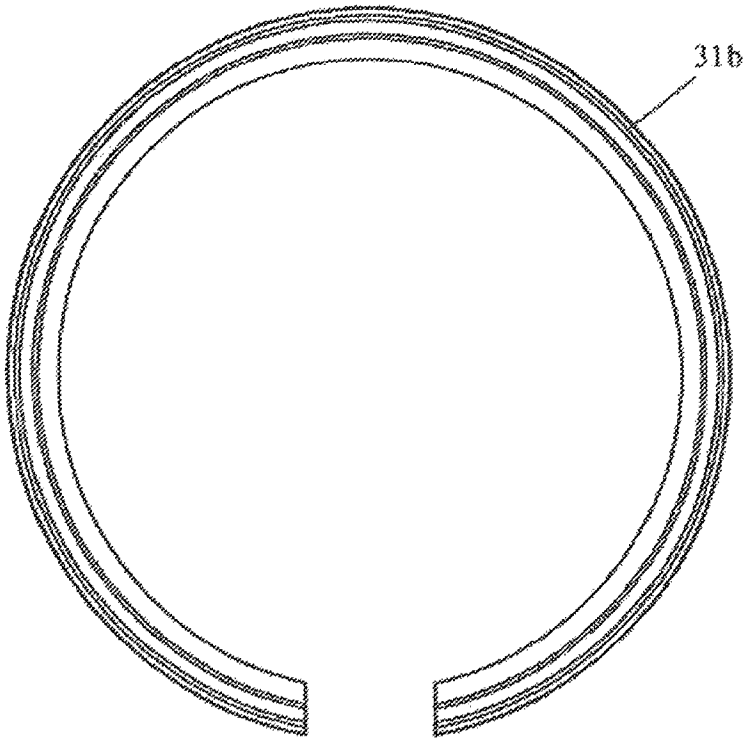
FIG. 14 A and FIG. 14B are a front view and a section view of a C-shaped elastic locking ring of the coaxial connector according to the third embodiment of the present invention.
Figure 14A:
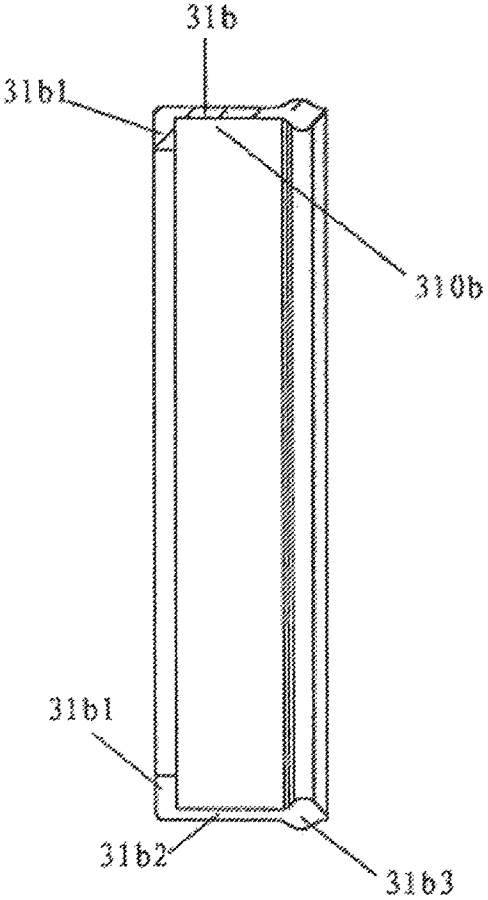
Figure 15:
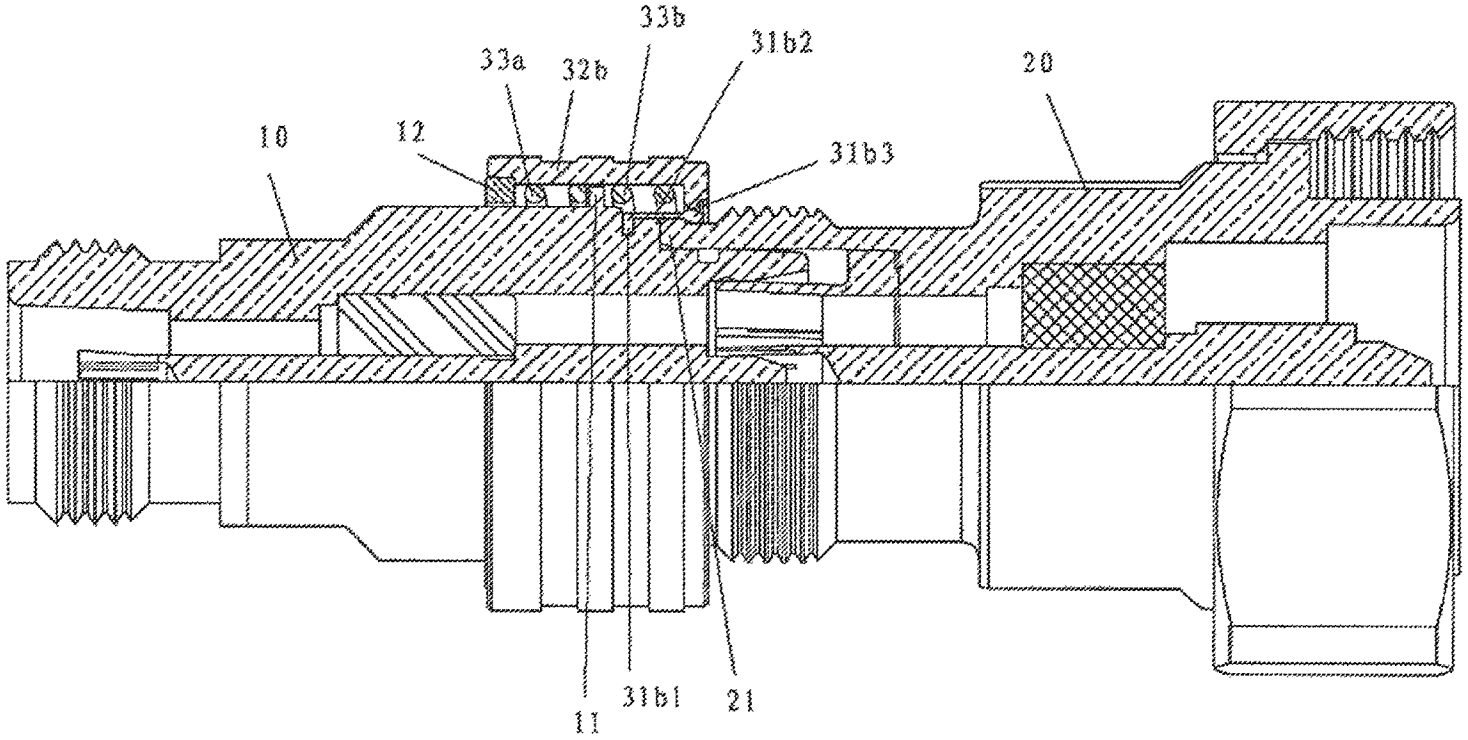
FIG. 15 is a partial section view of the coaxial connector according to the third embodiment of the present invention, wherein the first joint and the second joint are in a locking state, and a locking sleeve is at a locking position.

As shown in FIG. 13 to FIG. 15, the specific quick locking and separating mechanism 30*b* of the coaxial connector according to the third embodiment of the present invention comprises a C-shaped elastic locking ring 31*b*. The C-shaped elastic locking ring 31*b* comprises: a radial extension 31*b*1, wherein the radial extension 31*b*1 is arranged in a groove in the first end portion of the first joint 10; an axial extension 31*b*2, wherein the axial extension 31*b*2 extends along the axial direction from the radial extension 31*b*1; and a locking projection 31*b*3, wherein the locking projection 31*b*3 is arranged on an end portion of the axial extension 31*b*2 distal from the radial extension 31*b*1 and protrudes inwards and outwards along the radial direction, and the locking projection 31*b*3 forms, together with the radial extension 31*b*1 and the axial extension 31*b*2, a depression 310*b* used for accommodating the locking flange 21 of the second joint 20.

The specific quick locking and separating mechanism 30*b* further comprises a sliding sleeve 32*b*, and the sliding sleeve 32*b* is disposed around the first joint 10 and can slide between the locking position and the unlocking position. At the locking position of the sliding sleeve 32*b* (see FIG. 15), the locking projection 31*b*3 abuts against a projection 32*b*1 arranged on the inner circumferential surface of the sliding sleeve 32*b*, so as to prevent the C-shaped elastic locking ring 31*b* from expanding outwards along the radial direction, and accordingly, the locking flange 21 of the second joint 20 is locked in the depression 310*b* so as to connect the first joint 10 and the second joint 20; and at the unlocking position of the sliding sleeve 32*b*, the projection 32*b*1 on the inner circumferential surface of the sliding sleeve 32*b* does not abut against the locking projection 31*b*3, so as to allow the C-shaped elastic locking ring 31*b* to elastically deform outwards along the radial direction, and accordingly, the locking flange 21 of the second joint 20 is allowed to disengage from the depression 310*b* so as to permit the first joint 10 to be separated from the second joint 20.

As shown in FIG. 13 and FIG. 15, the adjoining surfaces of the locking projection 31*b*3 and the locking flange 21 of the second joint 20 are beveled surfaces, so as to facilitate the separating of the locking flange 21 of the second joint 20 from the locking projection 31*b*3. In addition, the adjoining surfaces of the locking projection 31*b*3 and the locking flange 21 of the second joint 20 are beveled surfaces as well.

In addition, as shown in FIG. 13, an outer end portion of the locking flange 21 of the second joint 20 facing the first joint 10 is provided with a beveled surface, in order to push the locking projection 31*b*3 outwards along the radial direction during the initial contact of the locking flange 21 with the locking projection 31*b*3 to force the C-shaped elastic locking ring 31*b* to expand, when connecting the first joint 10 and the second joint 20.

Similar to the first embodiment of the present invention, the quick locking and separating mechanism 30*b* of the coaxial connector of the third embodiment of the present invention is further provided with a pair of springs 33*a* and 33*b*. The pair of springs 33*a* and 33*b* acts on the sliding sleeve 32*b* along opposite directions in the axial direction, so that the sliding sleeve 32*b* is consistently kept at the locking position as shown in FIG. 15, when no external force is applied thereto. Specifically, a spring abutting portion 11 is arranged on the outer circumferential surface of the first joint 10, adjacent end portions of the pair of springs 33*a* and 33*b* abut against both sides of the spring abutting portion 11, and end portions of the pair of springs 33*a* and 33*b* distal from each other abut against a projection 32*b*1 located at one end portion and a stopper 12 connected to the other end portion of the sliding sleeve 32*b* respectively, accordingly, the pair of springs 33*a* and 33*b* acts on the sliding sleeve 32*b* along opposite directions in the axial direction, so that the sliding sleeve 32*b* is consistently kept at the locking position as shown in FIG. 15, when no external force is applied thereto. In the embodiment as shown in FIG. 13 to FIG. 15, the pair of springs 33*a* and 33*b* are compression springs which push the sliding sleeve 32*b* along opposite directions in the axial direction.

The connection and separation operations of the coaxial connector according to the third embodiment of the present invention are similar to those of the first embodiment and the second embodiment of the present invention, and thus will not be repeatedly descried herein.

Although a pair of springs 33*a* and 33*b* is shown in the above accompanying drawings, it should be understood that, more than one pair of springs can also be arranged or only one spring is arranged according to specific demands. In addition, the used term "beveled surface" should be understood as including any smoothly curved surface.

The coaxial connector 1 according to the first embodiment, the second embodiment and the third embodiment of the present invention can be used as a radio frequency coaxial connector.

Moreover, the coaxial connector 1 according to the first embodiment, the second embodiment and the third embodiment of the present invention is simple in structure and easy to manufacture, so that the manufacturing cost of the coaxial connector is reduced. The connection and separation of the coaxial connector 1 of the present invention are simple and reliable, and no additional tool is required. The coaxial connector 1 of the present invention can also be installed in high density, thereby saving the space.

Some preferred embodiments of the present invention are exemplarily described above in combination with the accompanying drawings. Those of ordinary skill in the art to which the present invention belongs should understand that, specific structures shown in the above embodiments are merely exemplary, rather than limiting. Moreover, those of ordinary skill in the art to which the present invention belongs can combine a variety of technical features shown above according to a variety of possible manners to constitute new technical solutions or make other modifications, and these new technical solutions are encompassed within the scope of the present invention.

The invention claimed is:

1. A coaxial connector with a quick locking and separating mechanism, comprising:

a first joint and a second joint, a locking flange being arranged at one end portion of the second joint; and a quick locking and separating mechanism for quickly connecting and separating the first joint and the second joint;

characterized in that, the quick locking and separating mechanism comprising:

a locking member fixedly arranged on a first end portion of the first joint and provided with a depression for accommodating the locking flange of the second joint; and a sliding sleeve arranged around the first joint and being slidable between a locking position in which the sliding sleeve locks the locking flange of the second joint in the depression of the locking member so as to connect the first joint and the second joint and an unlocking position in which the sliding sleeve allows the locking flange of the second joint to disengage from the depression of the locking member so as to allow the first joint to be separated from the second joint;

wherein the locking member is a closed locking ring comprising:

a first connecting portion fixedly arranged on the first end portion of the first joint;

a radial extension extending outwards from an end portion of the first connecting portion along a radial direction; and at least two elastic claws extending from the radial extension along an axial direction parallel to the first joint and forming, together with the radial extension, the depression for accommodating the locking flange of the second joint, an end portion of each of the elastic claws distal from the radial extension being provided with a radial locking portion extending inwards and outwards along the radial direction;

wherein, at the locking position of the sliding sleeve, the radial locking portion of each elastic claw abuts against a projection arranged on an inner circumferential surface of the sliding sleeve, so as to prevent the elastic claw from elastically deforming outwards along the radial direction and to lock the locking flange of the second joint in the depression so as to connect the first joint and the second joint; and wherein, at the unlocking position of the sliding sleeve, the projection on the inner circumferential surface of the sliding sleeve does not abut against the radial locking portions of the elastic claws, so as to allow the elastic claws to elastically deform outwards along the radial direction and to allow the locking flange of the second joint to disengage from the depression so as to allow the first joint to be separated from the second joint.

2. A coaxial connector with a quick locking and separating mechanism, comprising:

a first joint and a second joint, a locking flange being arranged at one end portion of the second joint; and a quick locking and separating mechanism for quickly connecting and separating the first joint and the second joint;

characterized in that, the quick locking and separating mechanism comprising:

a locking member fixedly arranged on a first end portion of the first joint and provided with a depression for accommodating the locking flange of the second joint; and a sliding sleeve arranged around the first joint and being slidable between a locking position in which the sliding sleeve locks the locking flange of the second joint in the depression of the locking member so as to connect the first joint and the second joint and an unlocking position in which the sliding sleeve allows the locking flange of the second joint to disengage from the depression of the locking member so as to allow the first joint to be separated from the second joint, characterized in that, the locking member is a C-shaped elastic locking ring comprising:

a first radial extension insertable into and movable within a slot arranged on an outer circumferential surface of the first joint;

an axial extension extending from a radial outer end portion of the first radial extension; and a second radial extension extending from an end portion of the axial extension distal from the first radial extension along a radial inward direction, wherein the second radial extension and the axial extension form the depression used for accommodating the locking flange of the second joint;

wherein, at the locking position of the sliding sleeve, the axial extension abuts against a projection arranged on the inner circumferential surface of the sliding sleeve, so as to compress the C-shaped elastic locking ring inwards along the radial direction so that the locking flange of the second joint is locked in the depression so as to connect the first joint and the second joint; and wherein, at the unlocking position of the sliding sleeve, the projection on the inner circumferential surface of the sliding sleeve does not abut against the axial extension, so as to allow the C-shaped elastic locking ring to elastically deform outwards along the radial direction to its initial shape, and when the C-shaped elastic locking ring is in its initial shape, the first radial extension is still inserted in the slot while the second radial extension disengage from the locking flange of the second joint, so as to enable the locking flange of the second joint to disengage from the depression and thus allow the first joint to be separated from the second joint; and wherein, a sliding sleeve locating portion is arranged on the outer circumferential surface of the axial extension of the C-shaped elastic locking ring, and a sliding sleeve locating counterpart is arranged on the projection on the inner circumferential surface of the sliding sleeve.

3. The coaxial connector with a quick locking and separating mechanism according to claim 1, characterized in that, the quick locking and separating mechanism is further provided with at least one pair of springs, each pair of springs acts on the sliding sleeve along opposite directions in the axial direction, so that the sliding sleeve is consistently kept at the locking position when no external force is applied thereto and that the sliding of the sliding sleeve along the two opposite directions in the axial direction can arrive at the unlocking position.

4. The coaxial connector with a quick locking and separating mechanism according to claim 3, characterized in that, the at least one pair of springs are compression springs which push the sliding sleeve along opposite directions in the axial direction.

5. The coaxial connector with a quick locking and separating mechanism according to claim 1, characterized in that, at least one of the adjoining surfaces of the radial locking portions of the elastic claws and the locking flange of the second joint is a beveled surface, so as to facilitate the separating of the locking flange of the second joint from the radial locking portions of the elastic claws.

6. The coaxial connector with a quick locking and separating mechanism according to claim 5, characterized in that, both the adjoining surfaces of the radial locking portions of the elastic claws and the locking flange of the second joint are beveled surfaces.

7. The coaxial connector with a quick locking and separating mechanism according to claim 1, characterized in that, an outer end portion of the locking flange of the second joint is provided with a beveled surface, in order to push the elastic claws outwards along the radial direction during the initial contact of the locking flange with the radial locking portions of the elastic claws so as to expand the elastic claws, when connecting the first joint and the second joint.

8. The coaxial connector with a quick locking and separating mechanism according to claim 2, characterized in that, one of the sliding sleeve locating portion and the sliding sleeve locating counterpart is a projection, and another of the sliding sleeve locating portion and the sliding sleeve locating counterpart is a depression.

9. The coaxial connector with a quick locking and separating mechanism according to claim 2, characterized in that, the C-shaped elastic locking ring is provided with at least one axial notch to reduce the force necessary for compressing the C-shaped elastic locking ring in the radial direction.

10. The coaxial connector with a quick locking and separating mechanism according to claim 9, characterized in that, the C-shaped elastic locking ring is provided with at least two axial notches uniformly distributed along the circumference of the C-shaped elastic locking ring, in order to reduce the force necessary for compressing the C-shaped elastic locking ring in the radial direction.

11. The coaxial connector with a quick locking and separating mechanism according to claim 2, characterized in that, one end portion of the projection on the inner circumferential surface of the sliding sleeve is provided with a beveled surface for applying a radial inward force to the C-shaped elastic locking ring, when moving sliding sleeve from the unlocking position to the locking position.

12. The coaxial connector with a quick locking and separating mechanism according to claim 2, characterized in that, at least one of an outer side end face of the second radial extension of the C-shaped elastic locking ring and an outer side end face of the locking flange of the second joint is provided with a beveled surface, so as to apply a radial outward expansion force to the C-shaped elastic locking ring through the axial movement of the second joint, when inserting the locking flange of the second joint into the depression in the C-shaped elastic locking ring.

13. The coaxial connector with a quick locking and separating mechanism according to claim 2, characterized in that, at least one of an inner side end face of the second radial extension of the C-shaped elastic locking ring and an inner side end face of the locking flange of the second joint is provided with a beveled surface, so as to apply a radial outward expansion force to the C-shaped elastic locking ring through the axial movement of the second joint, when inserting the locking flange of the second joint into the depression in the C-shaped elastic locking ring.

14. A coaxial connector with a quick locking and separating mechanism, comprising:

a first joint and a second joint, a locking flange being arranged at one end portion of the second joint; and a quick locking and separating mechanism for quickly connecting and separating the first joint and the second joint;

characterized in that, the quick locking and separating mechanism comprising:

a locking member fixedly arranged on a first end portion of the first joint and provided with a depression for accommodating the locking flange of the second joint; and a sliding sleeve arranged around the first joint and being slidable between a locking position in which the sliding sleeve locks the locking flange of the second joint in the depression of the locking member so as to connect the first joint and the second joint and an unlocking position in which the sliding sleeve allows the locking flange of the second joint to disengage from the depression of the locking member so as to allow the first joint to be separated from the second joint;

characterized in that the locking member is a C-shaped elastic locking ring comprising:

a radial extension arranged in a groove in a first end portion of the first joint;

an axial extension extending along the axial direction from the radial extension; and a locking projection arranged on an end portion of the axial extension distal from the radial extension and protruding inwards and outwards along the radial direction, wherein the locking projection forms, together with the radial extension and the axial extension, the depression used for accommodating the locking flange of the second joint;

wherein, at the locking position of the sliding sleeve, the locking projection abuts against a projection arranged on the inner circumferential surface of the sliding sleeve, so as to prevent the C-shaped elastic locking ring from expanding outwards along the radial direction, and to lock the locking flange of the second joint in the depression, so as to connect the first joint and the second joint; and wherein, at the unlocking position of the sliding sleeve, the projection on the inner circumferential surface of the sliding sleeve does not abut against the locking projection, so as to allow the C-shaped elastic locking ring to elastically deform outwards along the radial direction, and thus allow the locking flange of the second joint to disengage from the depression so as to allow the first joint to be separated from the second joint; and wherein the quick locking and separating mechanism is further provided with at least one pair of springs.

15. The coaxial connector with a quick locking and separating mechanism according to claim 14, characterized in that, at least one of the adjoining surfaces of the locking projection and the locking flange of the second joint is a beveled surface, so as to facilitate the separating of the locking flange of the second joint from the locking projection.

16. The coaxial connector with a quick locking and separating mechanism according to claim 15, characterized in that, both the adjoining surfaces of the locking projection and the locking flange of the second joint are beveled surfaces.

17. The coaxial connector with a quick locking and separating mechanism according to claim 14, characterized in that, an outer end portion of the locking flange of the second joint is provided with a beveled surface, so as to push the locking projection outwards along the radial direction during the initial contact of the locking flange with the locking projection to expand the C-shaped elastic locking ring, when connecting the first joint and the second joint.

18. The coaxial connector with a quick locking and separating mechanism according to claim 14, characterized in that, a spring abutting portion is arranged on the outer circumferential surface of the first joint, adjacent end portions of each pair of springs abut against both sides of the spring abutting portion, and end portions of each pair of springs distal from each other abut against both ends of the sliding sleeve, so that each pair of springs acts on the sliding sleeve along opposite directions in the axial direction, and thus the sliding sleeve is consistently kept at the locking position when no external force is applied thereto.

19. The coaxial connector with a quick locking and separating mechanism according to claim 14, characterized in that, the at least one pair of springs are compression springs which push the sliding sleeve along opposite directions in the axial direction.

20. The coaxial connector with a quick locking and separating mechanism according to claim 1, characterized in that, the coaxial connector is a radio frequency coaxial connector.

21. The coaxial connector with a quick locking and separating mechanism according to claim 1, characterized in that, the second joint is a standard 4.3/10.0 female connector.

* * * * *